US009164486B2

(12) United States Patent
Kawauchiya et al.

(10) Patent No.: US 9,164,486 B2
(45) Date of Patent: Oct. 20, 2015

(54) OPERATION STABILIZATION MECHANISM, MOVEMENT, AND MECHANICAL TIMEPIECE

(71) Applicant: SEIKO INSTRUMENTS INC., Chiba-shi, Chiba (JP)

(72) Inventors: Takuma Kawauchiya, Chiba (JP); Takashi Niwa, Chiba (JP); Masahiro Nakajima, Chiba (JP); Masayuki Koda, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/471,251

(22) Filed: Aug. 28, 2014

(65) Prior Publication Data

US 2015/0063083 A1 Mar. 5, 2015

(30) Foreign Application Priority Data

Sep. 4, 2013 (JP) ..... 2013-183352

(51) Int. Cl.
*G04B 17/06* (2006.01)
*G04B 17/28* (2006.01)
*G04B 1/22* (2006.01)

(52) U.S. Cl.
CPC ..... *G04B 17/285* (2013.01); *G04B 1/225* (2013.01)

(58) Field of Classification Search
CPC ..... G04B 17/285; G04B 15/10
USPC ..... 368/124–133
See application file for complete search history.

(56) References Cited

U.S. PATENT DOCUMENTS

| | | | | |
|---|---|---|---|---|
| 2003/0112709 | A1 * | 6/2003 | Mojon | 368/127 |
| 2004/0156273 | A1 * | 8/2004 | Mojon et al. | 368/127 |
| 2007/0127319 | A1 * | 6/2007 | Goeller | 368/124 |
| 2007/0147179 | A1 * | 6/2007 | Girardin et al. | 368/147 |

* cited by examiner

*Primary Examiner* — Edwin A. Leon
(74) *Attorney, Agent, or Firm* — Adams & Wilks

(57) ABSTRACT

An operation stabilization mechanism has a first carriage to which a rotational drive force of a train wheel is transmitted and which is rotatably supported with respect to a main plate, and a second carriage rotatably supported with respect to the first carriage. A constant-force spring is provided between the first carriage and the second carriage and is configured to impart a rotational force to the second carriage so that the second carriage undergoes rotation with respect to the first carriage. An escapement/governor mechanism is mounted in the second carriage and is configured to be driven by a rotational torque generated through rotation of the second carriage and transmitted to the escapement/governor mechanism. A stopper lever is mounted to undergo rotational movement relative to the first carriage for suppressing fluctuations in the rotational torque transmitted to the escapement/governor mechanism.

20 Claims, 22 Drawing Sheets

OPERATION STABILIZATION MECHANISM, MOVEMENT, AND MECHANICAL TIMEPIECE

BACKGROUND OF THE INVENTION

1. Field of the Invention

This invention relates to an operation stabilization mechanism, a movement, and a mechanical timepiece.

2. Description of the Related Art

In the mechanical timepiece, when the rotational torque transmitted from the barrel drum to the escape wheel & pinion of the escapement fluctuates in response to the unwinding of the main mainspring of the barrel drum, the oscillation angle of the balance with hairspring changes, resulting in a change in the rate of the timepiece. In view of this, to suppress the fluctuation in the rotational torque transmitted to the escape wheel & pinion, there has been proposed a constant-force device in which a constant-force spring (pre-tension spiral spring) is arranged between the barrel drum and the escapement.

As the constant-force device, there has been proposed, for example, one equipped with a stop wheel having a stop pinion portion (stop wheel pinion), an escape wheel & pinion having an escape pinion (escape wheel shaft), a tension ring mounted to a tension ring pinion, a constant-force spring provided between the tension ring and the escape wheel & pinion, and a cam mounted to the escape pinion. The constant-force spring imparts a rotational force to the escape wheel & pinion so that the escape wheel & pinion may rotate with respect to the tension ring.

Further, in the mechanical timepiece, there is involved an eccentricity error of a dynamic center of gravity based on the inevitable unevenness in the configuration of the balance with hairspring; further, during operation, there is also generated a movement of the center of gravity due to expansion and contraction of the hairspring. Thus, in the case where the timepiece is placed in the vertical position, the oscillation cycle of the balance with hairspring under the influence of the gravitational force undergoes a change depending upon what time direction comes on the upper side. As a mechanism for preventing a change in the oscillation cycle of the balance with hairspring due to the direction of the gravitational force, there is available a mechanism called tourbillon. And, there has been proposed a technique in which the above constant-force device is incorporated into the tourbillon mechanism.

The above-mentioned mechanism is equipped with a stationary wheel (second had fixing wheel), and a carriage (drive gear) rotating around the axis of this stationary wheel, with the escape wheel & pinion and the balance with hairspring being provided on the carriage. And, the escape wheel & pinion is rotated by the power of the constant-force spring. The rotation of the escape wheel & pinion is hindered or released by a pallet of a first anchor, whereas the rotation of a stop wheel is hindered or released by a pallet of a second anchor.

Here, when the rotation of the stop wheel is released, the stop wheel rotates by one tooth. Then, the stop wheel makes a planetary movement around the stationary wheel, with the carriage rotating. Further, when the rotation of the stop wheel is released, the tension ring rotates, whereby the constant-force spring is periodically wound up (See, for example, Japanese Patent No. 4105941 (Patent Document 1)).

In the above-described prior-art technique, however, the carriage rotates along with the rotation of the stop wheel, so that the rotational motion of the carriage is an intermittent motion. Thus, the inertia applied to the carriage applies a shock to the balance with hairspring, with the result that the rotation of the balance with hairspring becomes rather unstable.

SUMMARY OF THE INVENTION

This invention has been made in view of the problem with the above-described prior art technique. It is an object of the present invention to provide an operation stabilization mechanism, a movement, and a mechanical timepiece capable of stabilizing the operation of the balance with hairspring while preventing a change in the oscillation cycle of the balance with hairspring due to the gravitational force even in the case where a constant-force device is provided.

To achieve the above object, there is provided according to the present invention an operation stabilization mechanism including: a first carriage to which a drive force of a train wheel is transmitted and which is rotatably supported with respect to a main plate; a second carriage rotatably supported with respect to the first carriage; a constant-force spring provided between the first carriage and the second carriage and imparting a rotational force to the second carriage so that the second carriage may rotate with respect to the first carriage; and an escapement/governor mechanism mounted in the second carriage and configured to be driven through rotation of the second carriage.

Due to this construction, it is possible to smoothen the rotational operation of the second carriage in which the escapement/governor mechanism is mounted. That is, it is possible to mitigate the intermittent movement of the second carriage. Thus, it is possible to operate the balance with hairspring to operate in a stable manner while preventing a change in the oscillation cycle of the balance with hairspring due to the direction of the gravitational force.

To achieve the above object, the escapement/governor mechanism of the operation stabilization mechanism according to the present invention is equipped with an escape wheel & pinion rotating on the second carriage as the second carriage rotates, and a balance with hairspring undergoing rotational oscillation on the second carriage as the escape wheel & pinion rotates.

Due to this construction, it is possible to efficiently drive the second carriage, and to reduce the power loss of the operation stabilization mechanism.

To achieve the above object, in the operation stabilization mechanism according to the present invention, the first carriage is provided with a stop wheel; this stop wheel is equipped with a stop wheel bearing configured to rotate around the rotation axis of the first carriage through the rotation of the first carriage, a stop wheel shaft body rotatably supported by the stop wheel bearing, and a stop gear configured to rotate integrally with the stop wheel shaft body; and the second carriage is provided with a stopper configured to be engaged with the stop gear.

Due to this construction, it is possible to efficiently drive the first carriage, and to reduce the power loss of the operation stabilization mechanism.

To achieve the above object, the movement according to the present invention is provided with an operation stabilization mechanism.

Due to this construction, even in the case where a constant-force device is provided, it is possible to provide a movement capable of operating the balance with hairspring in a stable manner while preventing a change in the oscillation cycle of the balance with hairspring due to the direction of the gravitational force.

To achieve the above object, a mechanical timepiece according to the present invention is equipped with a movement.

Due to this construction, it is possible to provide a mechanical timepiece capable of operating the balance with hairspring in a stable manner while preventing a change in the oscillation cycle of the balance with hairspring due to the direction of the gravitational force.

According to the present invention, it is possible to smoothen the rotational operation of the second carriage in which the escapement/governor mechanism is mounted. That is, it is possible to reduce the intermittent operation of the second carriage. Thus, it is possible to operate the balance with hairspring in a stable manner while preventing a change in the oscillation cycle of the balance with hairspring due to the direction of the gravitational force.

DETAILED DESCRIPTION OF THE PREFERRED EMBODIMENTS

First Embodiment (Mechanical Timepiece)

Next, the first embodiment of this invention will be described with reference to FIGS. 1 through 11.

Figure 1:
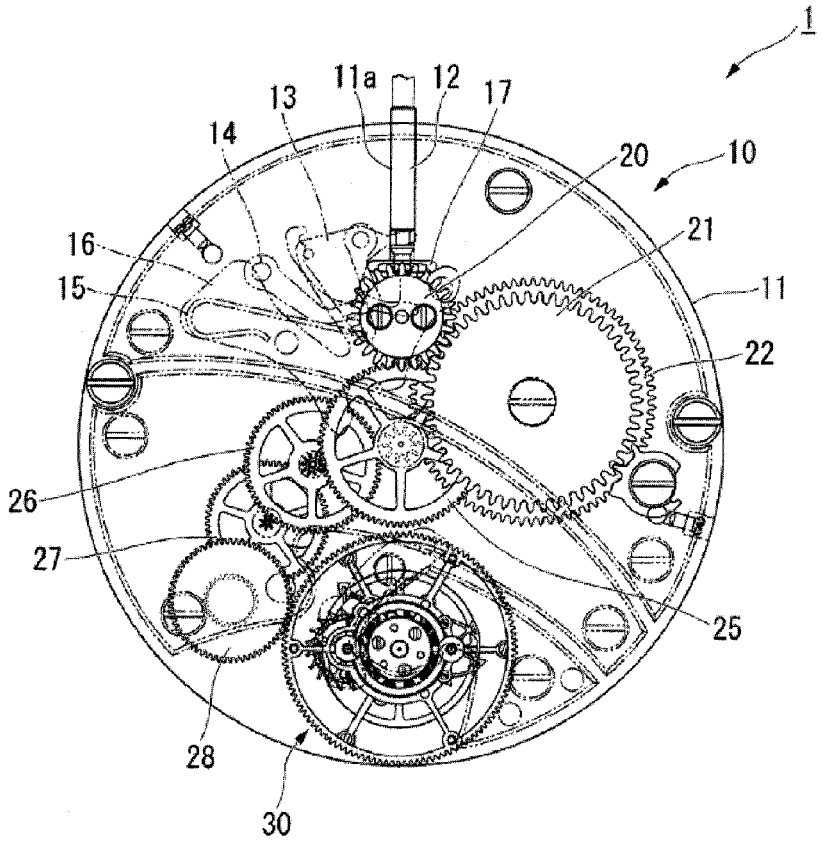
FIG. 1 is a plan view of the front side of a movement of a mechanical timepiece according to a first embodiment of the present invention.

FIG. 1 is a plan view of the front side of the movement of a mechanical timepiece 1.

As shown in the drawing, the mechanical timepiece 1 is composed of a movement 10, and a casing (not shown) accommodating this movement 10.

The movement 10 has a main plate 11 constituting the base plate. On the back side of this main plate 11, there is arranged a dial (not shown). A train wheel incorporated into the front side of the movement 10 will be referred to as the front train wheel, and a train wheel incorporated into the back side of the movement 10 will be referred to as the back train wheel.

The main plate 11 has a winding stem guide hole 11*a*, into which a winding stem 12 is rotatably incorporated. The axial position of this winding stem 12 is determined by a switching device having a setting lever 13, a yoke 14, a yoke spring 15, and a setting lever jumper 16. Further, a winding pinion 17 is rotatably provided on the guide shaft portion of the winding stem 12.

In this construction, when the winding stem 12 is turned in a state in which the winding stem 12 is at a first winding stem position ($0^{th}$ step), which is nearest to the inner side of the movement 10 along the rotation shaft, the winding pinion 17 rotates via the rotation of a clutch wheel (not shown). And, through this rotation of the winding pinion 17, a crown wheel 20 in mesh therewith rotates. And, through this rotation of the crown wheel 20, a ratchet wheel 21 in mesh therewith rotates. Further, through this rotation of the ratchet wheel 21, a main mainspring (not shown) accommodated in a movement barrel 22 is wound up.

Apart from the above-mentioned movement barrel 22, the front train wheel of the movement 10 is composed of a center wheel & pinion 25, a third wheel & pinion 26, a second wheel & pinion 27, and a fifth wheel & pinion 28, and exerts a function to transmit the rotational force of the movement barrel 22. Further, on the front side of the movement 10, there is arranged a tourbillon 30 with a constant-force device for controlling the rotation of the front train wheel.

The center wheel & pinion 25 is a gear in mesh with the movement barrel 22. The third wheel & pinion 26 is a gear in mesh with the center wheel & pinion 25. The second wheel pinion 27 is a gear in mesh with the third wheel & pinion 26. The fifth wheel & pinion 28 is a gear in mesh with the second wheel & pinion 27. And, the tourbillon 30 with a constant-force device is held in mesh with the fifth wheel & pinion 28.

(Tourbillon with a Constant-Force Device)

Figure 2:
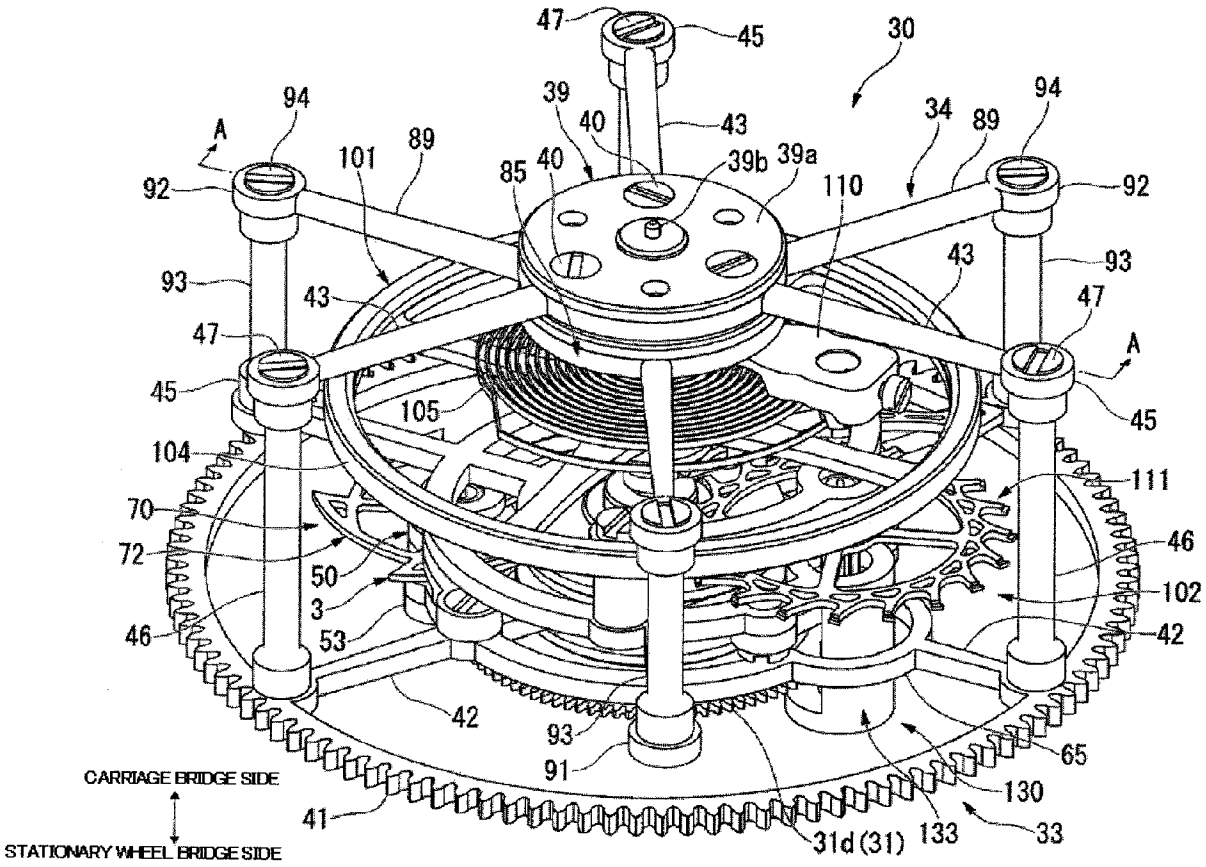
FIG. 2 is a perspective view of a tourbillon with a constant-force device according to the first embodiment of the present invention.
Figure 3:
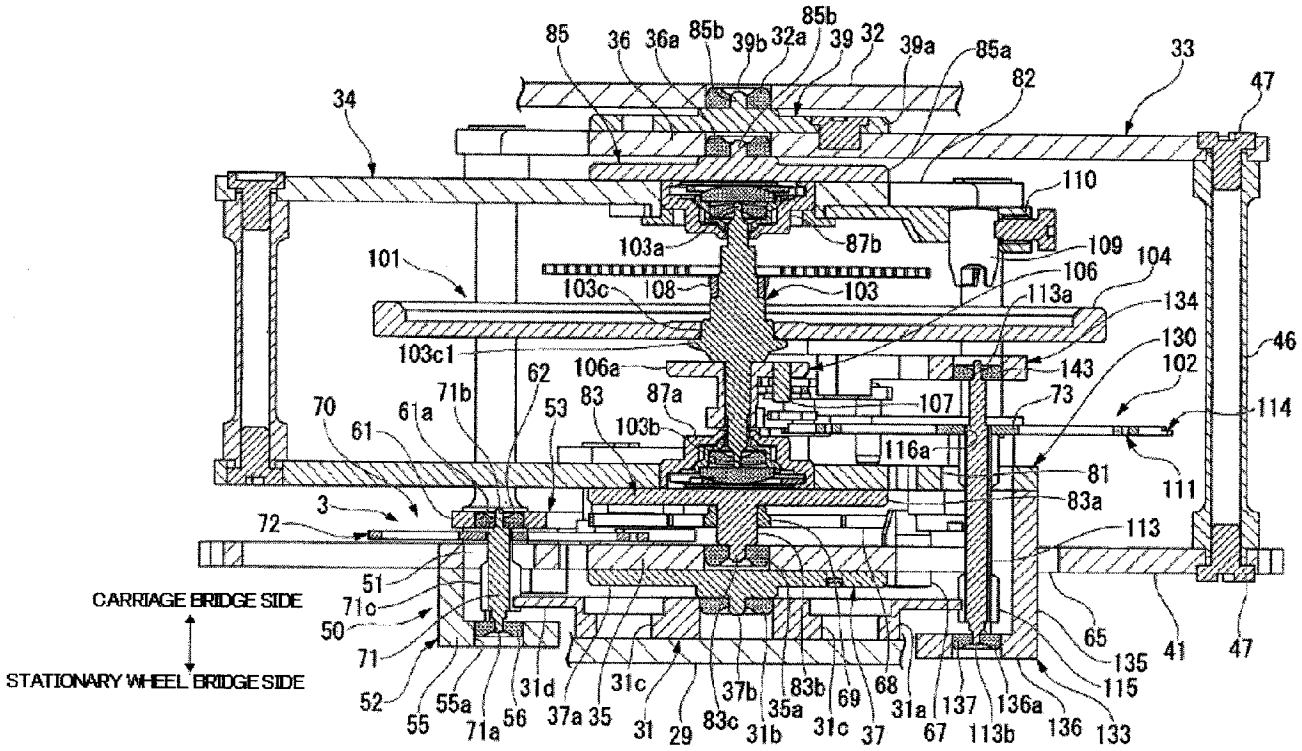
FIG. 3 is a sectional view taken along the line A-A of FIG. 2.

FIG. 2 is a perspective view of the tourbillon 30 with a constant-force device, and FIG. 3 is a sectional view taken along the line A-A of FIG. 2.

As shown in FIGS. 2 and 3, the tourbillon 30 with a constant-force device is a mechanism for controlling the rotation of the above-mentioned front train wheel. Further, the tourbillon 30 with a constant-force device has a so-called tourbillon mechanism which mitigates the influence of the gravitational force due to the orientation of a balance with hairspring 101 described below, and suppress disturbance of the operation of the balance with hairspring 101. Further, the tourbillon 30 with a constant-force device is equipped with a constant-force device 3 in order to suppress fluctuations in the rotational torque transmitted to an escape wheel & pinion 111 described below.

In the following, the tourbillon 30 with a constant-force device will be described in detail.

The tourbillon 30 with a constant-force device is equipped with a stationary wheel 31 fixed to the main plate 11 side of a stationary wheel bridge 29 mounted to the front side of the main plate 11, an outer carriage (input portion) 33 rotatably supported between itself and a carriage bridge 32 arranged opposite the stationary wheel bridge 29 (See FIG. 3), and an inner carriage (output portion) 34 supported on the inner side of the outer carriage 33 so as to be rotatable with respect to the outer carriage 33.

The stationary wheel 31 has a substantially disc-like gear main body 31*a*, and, substantially at the center in the radial direction of this gear main body 31*a*, there is provided a hole jewel 31*b* for rotatably supporting the outer carriage 33. Further, around the hole jewel 31*b* of the gear main body 31*a*, there is formed a screw insertion hole 31*c* for fastening the stationary wheel 31 to the stationary wheel bridge 29. A screw (not shown) is inserted into this screw insertion hole 31*c*. Further, a toothed portion 31*d* is formed on the outer peripheral portion of the gear main body 31*a*.

(Outer Carriage)

Figure 4:
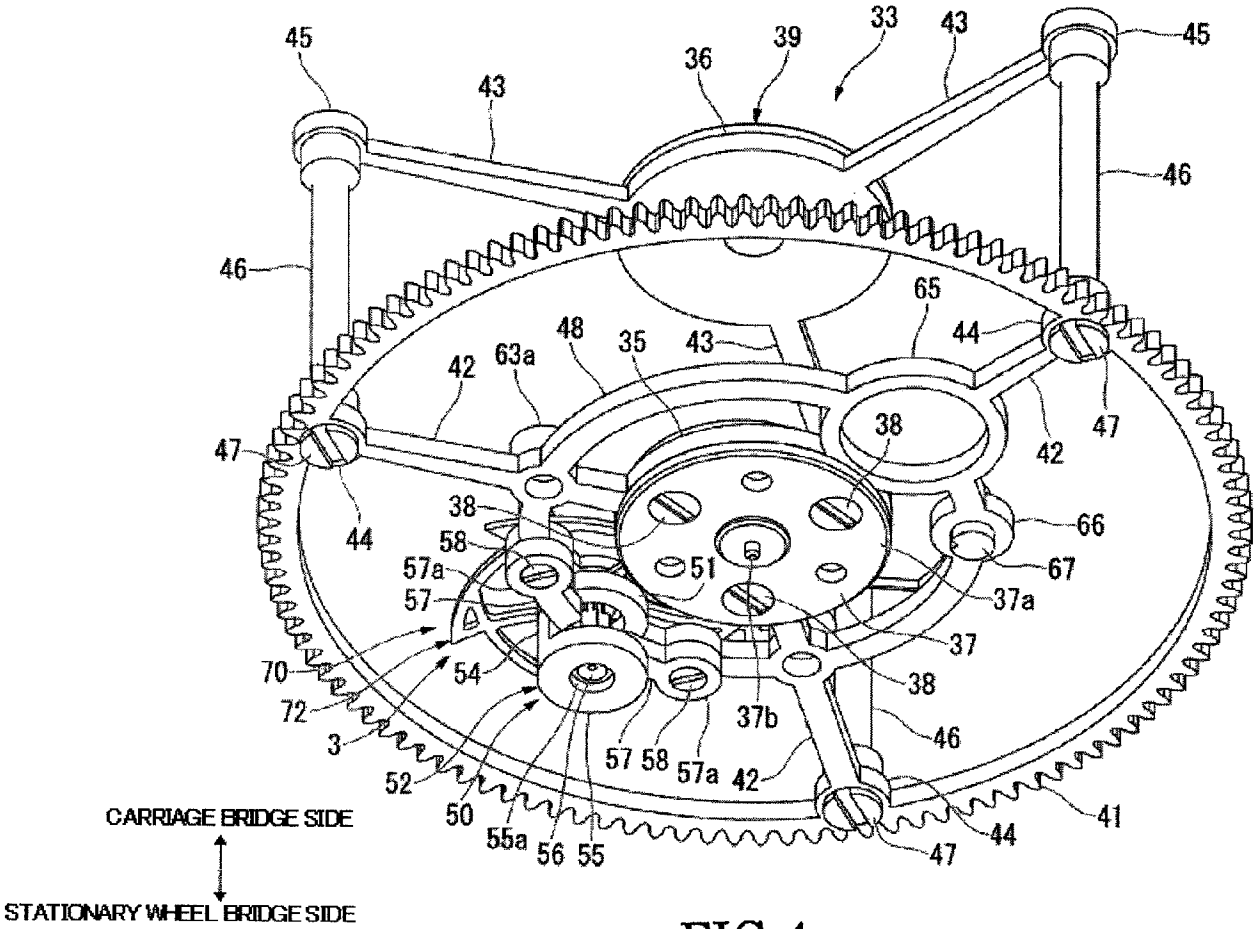
FIG. 4 is a perspective view, as seen from a stationary wheel bridge side, of an outer carriage according to the first embodiment of the present invention.
Figure 5:
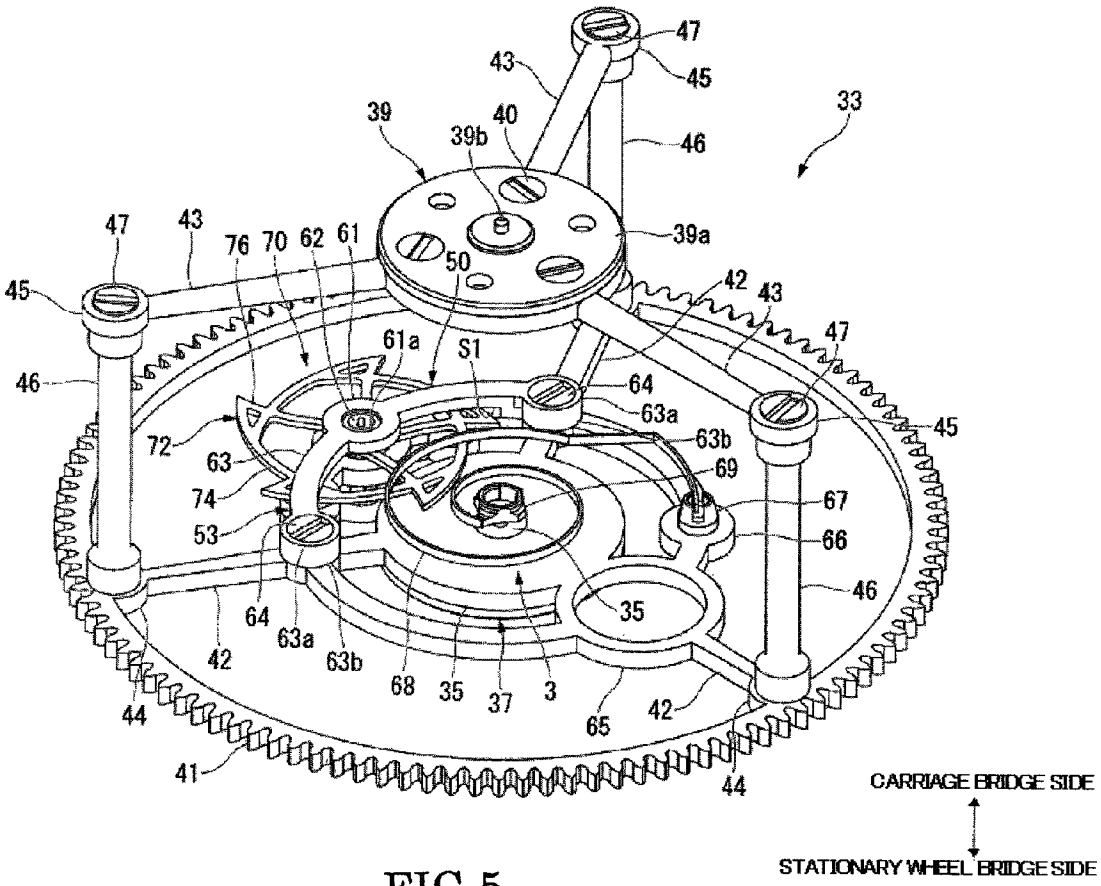
FIG. 5 is a perspective view, as seen from a carriage bridge side, of the outer carriage according to the first embodiment of the present invention.

FIG. 4 is a perspective view of the outer carriage 33 as seen from the stationary wheel bridge 29 side, and FIG. 5 is a perspective view of the outer carriage 33 as seen from the carriage bridge 32 side.

As shown in FIGS. 2 through 5, the outer carriage 33 has a substantially disc-like first outer carriage bearing portion 35 arranged on the stationary wheel bridge 29 side, and a substantially disc-like second outer carriage bearing portion 36 arranged on the carriage bridge 32 side. The first outer carriage bearing portion 35 and the second outer carriage bearing portion 36 are arranged coaxially with the stationary wheel 31.

Further, the first outer carriage bearing portion 35 is provided with a hole jewel 35*a* coaxial with the hole jewel 31*b* of the stationary wheel 31. This hole jewel 35*a* is used to rotatably support the inner carriage 34. Further, a first outer rotary member 37 is provided on the stationary wheel bridge 29 side surface of the first outer carriage bearing portion 35.

The first outer rotary member 37 is formed by integrating a base portion 37*a* formed in a substantially disc-like configuration so as to be in correspondence with the configuration of the first outer carriage bearing portion 35, and a cog portion 37*b* protruding toward the stationary wheel bridge 29 side from substantially the center in the radial direction of the base portion 37*a*. And, the base portion 37*a* is fastened to the first outer carriage bearing portion 35 by the screw 38. Further, the cog portion 37*b* is inserted into the hole jewel 31*b* of the stationary wheel 31, whereby the first outer rotary member 37 is rotatably supported by the stationary wheel 31.

On the other hand, the second outer carriage bearing portion 36 is provided with a hole jewel 36*a* coaxial with the hole jewel 35*a* of the first outer carriage bearing portion 35. This hole jewel 36*a* is also used to rotatably support the inner carriage 34 in cooperation with the hole jewel 35*a* of the first outer carriage bearing portion 35. Further, a second outer rotary member 39 is provided on the carriage bridge 32 side surface of the second outer carriage bearing portion 36.

The second outer rotary member 39 is formed by integrating a base portion 39*a* formed in a substantially disc-like configuration so as to be in correspondence with the configuration of the second outer carriage bearing portion 36, and a cog portion 39*b* protruding toward the carriage bridge 32 side from substantially the center in the radial direction of the base portion 39*a*. This cog portion 39*b* is rotatably supported by the hole jewel 32*a* of the carriage bridge 32. Further, the base portion 39*a* is fastened to the second outer carriage bearing portion 36 by a screw 40.

Further, on the radially outer side of the first outer carriage bearing portion 35, there is provided a ring-like external gear portion 41. This external gear portion 41 is in mesh with the fifth wheel & pinion 28.

Further, the external gear portion 41 and the first outer carriage bearing portion 35 are connected to each other by three first arm portions 42. The three first arm portions 42 extend in the radial direction, and are arranged at equal intervals in the peripheral direction.

On the other hand, on the outer peripheral portion of the second outer carriage bearing portion 36, there are integrally formed three second arm portions 43 extending radially outwards. These second arm portions 43 are arranged at equal intervals in the peripheral direction so as to be in correspondence with the first arm portions 42 on the first outer carriage bearing 35 side.

At the connection portions between the first arm portions 42 and the external gear portion 41, and at the distal ends of the second arm portions 43, there are integrally formed substantially disc-like shaft mounting seats 44 and 45. And, between these shaft mounting seats 44 and 45, there is provided a shaft 46 extending along the axial direction. Both ends of the shaft 46 are fastened to the shaft mounting seats 44 and 45 by screws 47 threaded-in from above the shaft mounting seats 44 and 45.

Further, between the first outer carriage bearing portion 35 and the external gear portion 41, there is provided a support bar 48 formed in a ring-like configuration so as to surround the first outer carriage bearing portion 35. The inner diameter of the support bar 48 is set to be substantially equal to the outer diameter of the toothed portion 31*d* of the stationary wheel 31.

Further, the support bar 48 is integrally formed so as to be connected with the first arm portion 42. The support bar 48 is provided with a stop wheel bearing unit 50, and a stop wheel 70 rotatably supported by this stop wheel bearing unit 50.

Here, the stop wheel bearing unit 50 and the stop wheel 70 constitute a constant-force device 3; the constant-force device 3 has a constant-force spring 68 and a stopper 96 described below apart from the stop wheel bearing unit 50 and the stop wheel 70.

The stop wheel bearing unit 50 is formed by a ring-like shaft body insertion portion 51 integrally formed on the support bar 48, a first stop wheel bearing portion 52 mounted to the stationary wheel bridge 29 side of the support bar 48, and a second stop wheel bearing portion 53 mounted to the carriage bridge 32 side of the support bar 48.

The first stop wheel bearing portion 52 has a wall portion 54 extending toward the stationary wheel bridge 29 side from the position of the support bar 48 corresponding to the shaft body insertion portion 51. The wall portion 54 is formed in a substantially C-shaped sectional configuration so as to be open radially on the inner side. On the inner peripheral surface side of the distal end of the wall portion 54, there is integrally formed a substantially disc-like bearing seat 55 so as to be orthogonal to the wall portion 54. And, substantially at the center in the radial direction of the bearing seat 55, there is formed a through-hole 55*a* extending therethrough in the thickness direction. In this through-hole 55*a*, there is provided a hole jewel for rotatably supporting the stop wheel 70.

Further, at the proximal end side of the wall portion 54, there are integrally formed a pair of mounting stays 57 extending on both sides with this wall portion 54 therebetween. At the distal ends of the pair of mounting stays 57, there are respectively integrally formed substantially disc-like screw seats 57*a*. These screw seats 57*a* are fastened to the support bar 48 by screws 58.

On the other hand, the second stop wheel bearing portion 53 has a substantially disc-like bearing seat 61 arranged at a position corresponding to the shaft body insertion portion 51 formed in the support bar 48. And, substantially at the center in the radial direction of the bearing seat 61, there is formed a through-hole 61*a* extending therethrough in the thickness direction. In this through-hole 61*a*, there is provided a hole jewel 62 for rotatably supporting the stop wheel 70.

Further, on the outer peripheral portion of the bearing seat 61, there are integrally formed, on both sides of the hole jewel 62, a pair of mounting stays 63. At the distal ends of the pair of mounting stays 63, there are respectively integrally formed substantially disc-like screw seats 63*a*. The screw seats 63*a* are fastened to the support bar 48 by screws 64.

Here, at the distal end portions of the screw seats 63*a* and the mounting stays 63, there are formed raised portions 63*b*, with a gap S1 being formed between the bearing seat 61 and the mounting stays 63 and the support bar 48. A stop gear 72 constituting the stop wheel 70 is provided in this gap S1.

Apart from the stop gear 72, the stop wheel 70 has a stop wheel shaft body 71 inserted into the shaft body insertion portion 51 formed in the support bar 48. At both ends of the stop wheel shaft body 71, there are integrally formed cog portions 71*a* and 71*b*. The stationary wheel bridge 29 side cog portion 71*a* is rotatably supported by the hole jewel 56 of the first stop wheel bearing portion 52. On the other hand, the carriage 32 side cog portion 71*b* is rotatably supported by the hole jewel 62 of the second stop wheel bearing portion 53.

Further, on the portion of the stop wheel shaft body 71 from substantially the center in the axial direction to a position in front of the stationary wheel bridge 29 side cog portion 71*a*, there is integrally formed a stop pinion portion 71*c*. Here, the inner diameter of the support bar 48 on which the stop wheel bearing unit 50 is provided is set to be substantially the same as the outer diameter of the toothed portion 31*d* of the stationary wheel 31, so that the stop pinion portion 71*c* is in mesh with the toothed portion 31*d*. On the other hand, a stop gear 72 is fitted onto the portion for fixation in the vicinity of the root portion of the cog portion 71*b* on the carriage bridge 32 side of this stop wheel shaft body 71, and the stop wheel shaft body 71 and the stop gear 72 are integrated with each other so as to be incapable of relative rotation.

Figure 6:
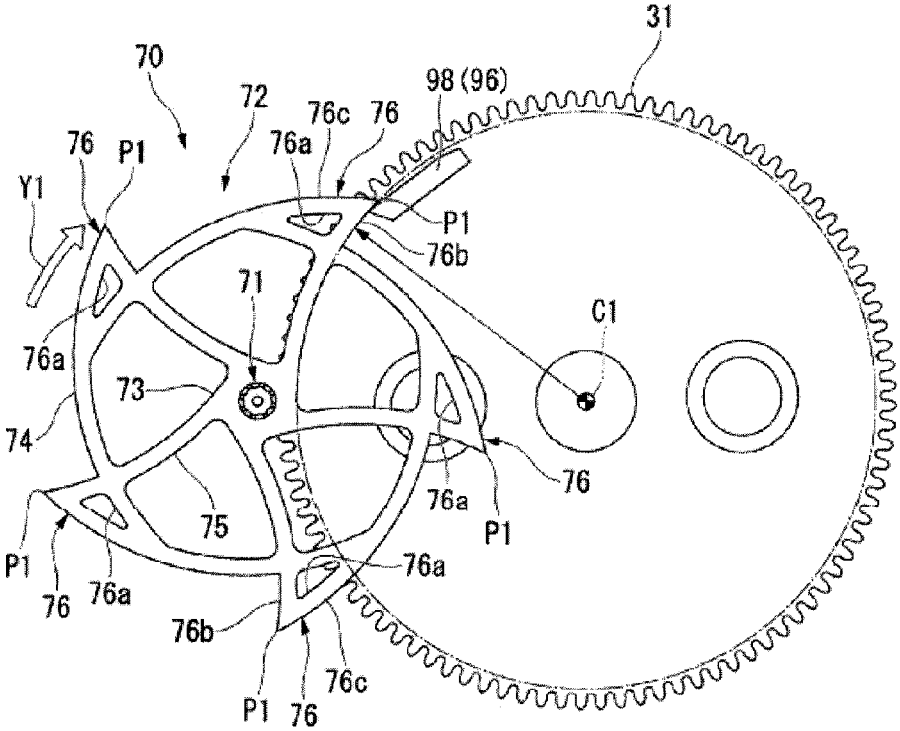
FIG. 6 is a plan view of a stop gear according to the first embodiment of the present invention.

FIG. 6 is a plan view of the stop gear 72.

As shown in the drawing, the stop gear 72 is a member formed, for example, of a metal material or a material exhibiting a crystal orientation such as a single crystal silicon; it is formed by the LIGA (Lithographie Galvanoformung Abformung) process, DRIE (Deep Reactive Ion Etching), MIM (Metal Injection Molding), etc. utilizing electrocasting or an optical method such as photolithography.

The stop gear 72 is formed by integrating a central hub portion 73 fitted onto the stop wheel shaft body 71, a rim portion 74 arranged on the outer side in the radial direction of the hub portion 73 and formed in a ring-like configuration so as to surround the periphery of the hub portion 73, and a spoke portion 75 connecting the hub portion 73 and the rim portion 74.

On the outer peripheral portion of the rim portion 74, there protrude radially outwards a plurality of (five in this embodiment) hook portions 76. More specifically, the hook portions 76 are formed in a substantially triangular configuration as seen in plan view in the axial direction, with a substantially triangular opening 76*a* occupying the major central portion. Further, each hook portion 76 is formed such that the apex P1 thereof is directed in the rotational direction (the clockwise direction in FIG. 6) Y1 of the stop gear 72, and the front side 76*b* in the rotational direction Y1 is set to be shorter than the rear side 76*c* in the rotational direction Y1. In other words, the front side 76*b* is formed so as to be continuous with the spoke portion 75, whereas the rear side 76*c* is formed so as to be continuous with the rim portion 74. The rotational operation of the stop gear 72 will be described in detail below.

Here, the spoke portion 75 and the front side 76*b* are formed in an arcuate configuration. And, the center of this arc is situated coaxially with the axis C1 of the stationary wheel 31, that is, the rotation center of the outer carriage 33.

In this construction, a stopper 96 described below and provided on the inner carriage 34 is engaged with and released from the front side 76*b* of each hook portion 76.

Apart from this, as shown in FIGS. 4 and 5, on the support bar 48, there is integrally formed a ring-like bearing unit insertion portion 65 on the side radially opposite the shaft boy insertion portion 51 of the first outer carriage bearing portion 35. Inserted into this bearing unit insertion portion 65 is a bearing portion 133 of an escapement mechanism bearing unit 130 described below. Further, one of three first arm portions 42 protrudes from the outer peripheral portion of the bearing unit insertion portion 65.

Further, on the support bar 48, there is integrally formed a stud support 66 at a position adjacent to the bearing unit insertion portion 65. A stud 67 is forced into this stud support 66. An outer end portion of the constant-force spring 68 is fixed to the stud 67.

The constant-force spring 68 serves to impart a rotational force to the inner carriage 34 with respect to the outer carriage 33, and is formed in a spiral configuration. The inner end portion of the constant-force spring 68 is fixed to the inner carriage 34 via a collet 69.

Figure 7:
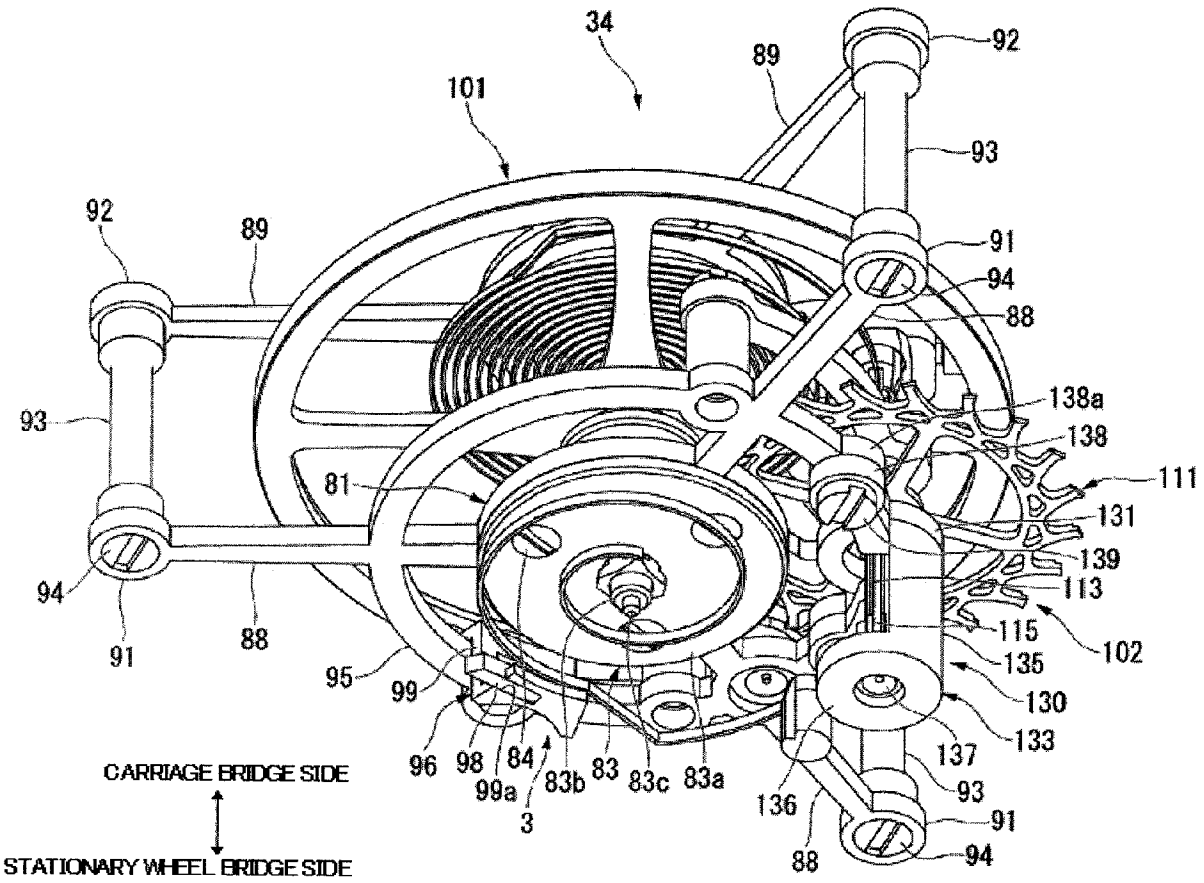
FIG. 7 is a perspective view, as seen from the stationary wheel bridge side, of an inner carriage according to the first embodiment of the present invention.
Figure 8:
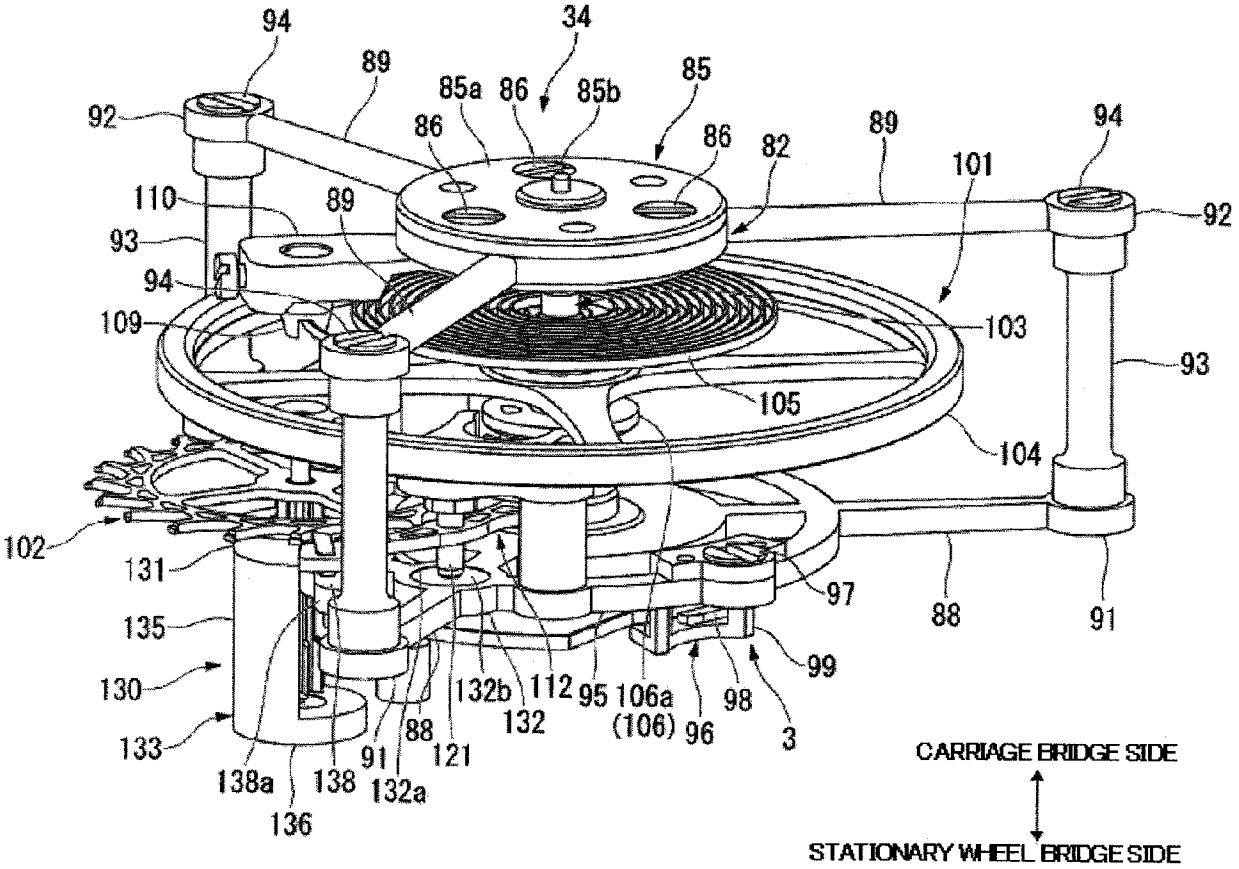
FIG. 8 is a perspective view, as seen from the carriage bridge side, of the inner carriage according to the first embodiment of the present invention.

FIG. 7 is a perspective view of the inner carriage 34 as seen from the stationary wheel bridge 29 side, and FIG. 8 is a perspective view of the inner carriage 34 as seen from the carriage bridge 32 side.

As shown in FIGS. 2, 3, 7, and 8, the inner carriage 34 has a substantially disc-like first inner carriage bearing portion 81 arranged on the stationary wheel bridge 29 side, and a substantially disc-like second carriage bearing portion 82 arranged on the carriage bearing 32 side. The first inner carriage bearing portion 81 and the second inner carriage bearing portion 82 are arranged coaxially with the first outer carriage bearing portion 35 and the second outer carriage bearing portion 36 of the outer carriage 33.

Further, a first inner rotary member 83 is provided on the first outer carriage bearing portion 35 side surface of the first inner carriage bearing portion 81. The first inner rotary member 83 is integrally formed by a base portion 83*a* formed in a substantially disc-like configuration, a shaft portion 83*b* protruding toward the first outer carriage bearing portion 35 side from substantially the radial center of the base portion 83*a*, and a cog portion 83*c* protruding from the distal end of the shaft portion 83*b*, so as to be in correspondence with the configuration of the first inner carriage bearing portion 81.

And, the base portion 83*a* is fastened to the first inner carriage bearing portion 81 by a screw 84. Further, the cog portion 83*c* is inserted into the hole jewel 35*a* of the first outer carriage bearing portion 35, whereby the inner carriage 34 is rotatably supported with respect to the outer carriage 33.

Further, the collet 69 of the constant-force spring 68 is fixed to the shaft portion 83*b*. As a result, the urging force of the constant-force spring 68 is applied to the inner carriage 34 with respect to the outer carriage 33. That is, a rotational force is imparted to the inner carriage 34 by the constant-force spring 68 with respect to the outer carriage 33.

On the other hand, a second inner rotary member 85 is provided on the second outer carriage bearing portion 36 side surface of the second inner carriage bearing portion 82. The second inner rotary member 85 is integrally formed by a substantially disc-like base portion 85*a*, and a cog portion 85*b* protruding toward the second outer carriage bearing portion 36 side from substantially the radial center of the base portion 85*a*, so as to be in correspondence with the configuration of the second inner carriage bearing portion 82. This cog portion 85*b* is rotatably supported by the hole jewel 36*a* of the second outer carriage bearing portion 36. Further, the base portion 85*a* is fastened to the second inner carriage bearing portion 82 by a screw 86.

Further, the first inner carriage bearing portion 81 and the second inner carriage bearing portion 82 are respectively provided with quake resisting bearings 87*a* and 87*b*. The quake resisting bearings 87*a* and 87*b* are arranged coaxially with the hole jewel 35*a* of the first outer carriage bearing portion 35 and the hole jewel 36*a* of the second outer carriage bearing portion 36. The quake resisting bearings 87*a* and 87*b* serve to rotatably support a balance with hairspring 101 described below.

Further, on the outer peripheral portion of the first inner carriage bearing portion 81, there are integrally formed three first arm portions 88 extending radially outwards. Further, on the outer peripheral portion of the second inner carriage bearing portion 82, there are integrally formed three second arm portions 89 extending radially outwards. The first arm portions 88 and the second arm portions 89 are arranged at equal peripheral intervals; further, they are arranged so as to face each other in the axial direction. Further, the first arm portions 88 are arranged so as to be situated between the three first arm portions 42 formed on the outer carriage 33. Further, the second arm portions 89 are arranged so as to be situated between the three second arm portions 43 formed on the outer carriage 33.

Further, at the distal ends of the arm portions 88 and 89, there are respectively integrally formed substantially disc-like shaft mounting seats 91 and 92. And, between these shaft mounting seats 91 and 92, there is provided an axially extending shaft 93. Both ends of the shaft 93 are fastened to the shaft mounting seats 91 and 92 by screws 94 threaded into from above the shaft mounting seats 91 and 92.

Further, on the radially outer side of the first inner carriage bearing portion 81, there is provided a support bar 95 formed in a ring-like configuration so as to surround the periphery of the first inner carriage bearing portion 81. The inner diameter of the support bar 95 is set to be substantially the same as the outer diameter of the toothed portion 31*d* of the stationary wheel 31. Further, the support bar 95 is formed integrally with the first arm portion 88 so as to be connected therewith.

The support bar 95 is provided with the stopper 96. The stopper 96 serve to effect engagement/releasing with respect to the hook portions 76 of the stop wheel 70 with the rotational movement of the stopper wheel 70 provided on the inner carriage 34 and the outer carriage 33 (as will be described in detail below).

The stopper 96 is composed of a pawl portion 98 coming into contact with the hook portions 76 of the stop wheel 70, and a support portion 99 supporting the pawl portion 98. The support portion 99 is formed in a substantially Z-shaped sectional configuration, and has, on the stationary wheel bridge 29 side, a slit 99*a* so that the stop wheel 70 side may be open. The pawl portion 98 is accommodated in this slit 99*a* and is fixed in position therein. Further, the side of the support portion 99 opposite the side to which the pawl portion 98 is fixed is fastened to the support bar 95 by a screw 97.

Further, the support bar 95 is provided with an escapement mechanism bearing unit 130. The escapement mechanism bearing unit 130 supports an escapement mechanism 102 described below.

Figure 9:
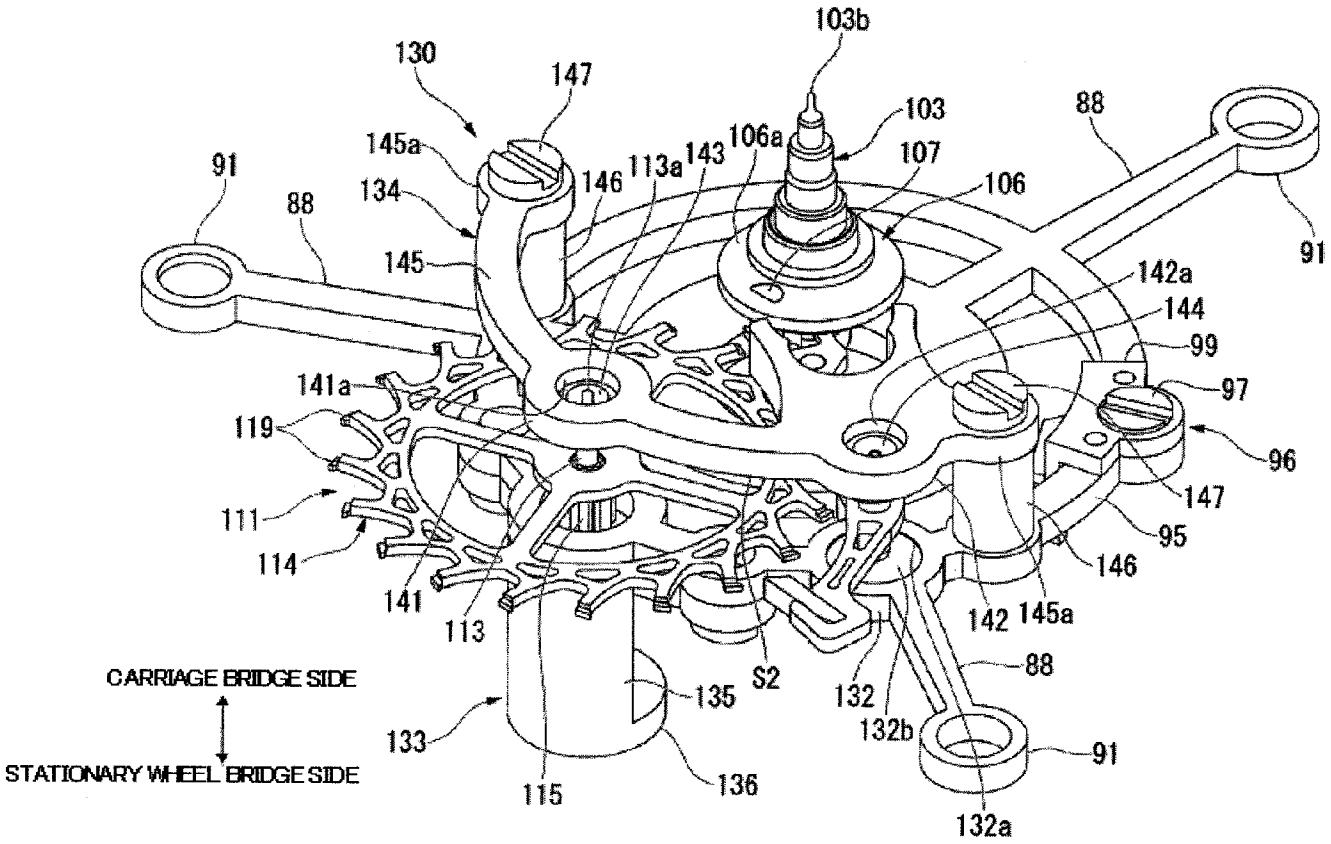
FIG. 9 is a perspective view of an escapement mechanism bearing unit according to the first embodiment of the present invention.

FIG. 9 is a perspective view of the escapement mechanism bearing unit 130.

As shown in FIGS. 7 through 9, the escapement mechanism bearing unit 130 is composed of a ring-like shaft body insertion portion 131 integrally formed on the support bar 95, a substantially disc-like bearing seat 132, a bearing portion 133 mounted to the stationary wheel bridge 29 side of the support bar 95, and an escapement mechanism holder 134 mounted to the carriage bridge 32 side of the support bar 95.

The shaft body insertion portion 131 is arranged on the side radially opposite the shaft body insertion portion 51 of the outer carriage 33, with the first inner rotary member 83 therebetween. Further, the bearing seat 132 is adjacent to the shaft body insertion portion 131 and situated at a position where the support bar 95 and the first arm portion 88 are connected together. Substantially at the center in the radial direction of the bearing seat 132, there is formed a through-hole 132*a* extending therethrough in the thickness direction; and a hole jewel 132*b* is provided here.

Further, the bearing portion 133 has a wall portion 135 extending toward the stationary wheel bridge 29 side from a position corresponding to the shaft body insertion portion 131 of the support bar 95. This wall portion 135 is inserted into the bearing unit insertion portion 65 formed in the outer carriage 33, and is formed to extend to the stationary wheel 31. Further, the wall portion 35 is formed in a substantially C-shaped sectional configuration so that the radially inner side thereof may be open. On the inner peripheral surface side of the distal end of the wall portion 135, there is formed a substantially disc-like bearing seat 136 so as to be orthogonal to the wall portion 135. And, at substantially at the center in the radial direction of the bearing seat 136, there is formed a through-hole 136*a* extending therethrough in the thickness direction; and a hole jewel 137 is provided here.

Further, at the proximal end side of the wall portion 135, there are integrally formed a pair of mounting stays 138 extending on both sides of the wall portion 135. At the distal ends of the pair of mounting stays 138, there are respectively integrally formed substantially disc-shaped screw seats 138*a*. The screw seats 138*a* are fastened to the support bar 95 by screws 139.

On the other hand, the escapement mechanism holder 134 has two substantially disc-like bearing seats 141 and 142 respectively arranged at positions corresponding to the shaft body insertion portion 131 and the bearing seats 132 formed on the support bar 95. Substantially at the centers in the radial direction of these bearing seats 141 and 142, there are formed through-holes 141*a* and 142*a* extending therethrough in the thickness direction. Hole jewels 143 and 144 are respectively provided in these through-holes 141*a* and 142*a*.

Further, the escapement mechanism holder 134 has a mounting stay 145 connecting the bearing seats 141 and 142. The mounting stay 145 is formed in a substantially arcuate configuration in plan view as seen in the axial direction so as to be in correspondence with the configuration of the support bar 95. At both ends of the mounting stay 145, there are formed substantially disc-like screw seats 145*a*. The screw seats 145*a* are mounted to the support bar 95 via spacers 146. And, the screw seats 145*a* are fastened to the support bar 95 by screws 147.

Here, the escapement mechanism holder 134 is fixed to the support bar 95 via the spacers 146, so that a gap S2 is formed between the support bar 95 and the escapement mechanism holder 134. An escapement mechanism 102 is provided in this gap S2. The balance with hairspring 101 is provided between the quake resisting bearings 87*a* and 87*b* of the inner carriage 34 constructed as described above.

As shown in FIGS. 3 and 8, the balance with hairspring 101 is equipped with a balance staff 103 rotatably supported by the quake resisting bearing 87*a* of the first inner carriage bearing portion 81 and the quake resisting bearing 87*b* of the second carriage bearing portion 82, a balance wheel 104 mounted to the balance staff 103, and a hairspring 105, and makes normal and reverse rotation at a fixed oscillation cycle by the power transmitted from the hairspring 105.

The balance staff is a shaft body formed so as to be gradually reduced in diameter stepwise from substantially the center in the axial direction toward both axial ends. At both ends of the balance staff 103, there respectively protrude cog portions 103*a* and 103*b* axially outwards. The cog portions 103*a* and 103*b* are respectively rotatably supported by the quake resisting bearings 87*a* and 87*b*. The balance wheel 104 is fitted onto a large diameter portion 103*c* of maximum shaft diameter at substantially the center in the axial direction, and is integrated with the balance staff 103 so as to be incapable of relative rotation. The large diameter portion 103*c* has an outer flange portion 103*c*1 on the first inner carriage bearing 81 side of the balance wheel 104. The position in the axial direction of the balance wheel 104 is determined by this outer flange portion 103*c*1.

Further, a tubular double roller 106 is fitted to the side of the outer flange portion 103*c*1 opposite the balance wheel 104. At the large diameter portion 103*c* side end of this double roller 106, there is integrally formed an annular flange portion 106*a* protruding radially outwards. This flange portion 106*a* is provided with an impulse pin 107 (See FIG. 3). The impulse pin 107 serves to swing a pallet fork 112 described below constituting the escapement mechanism 102.

The hairspring 105 is, for example, a flat spring wound spirally within a plane; and the inner end portion thereof is fixed to the second carriage bearing portion 82 side of the large diameter portion 103*c* of the balance staff 103 via a collet 108. On the other hand, a stud 109 is mounted to the outer end portion of the hairspring 105. The stud 109 is fixed to a stud support 110 provided at the second inner carriage bearing portion 82. And, the hairspring 105 accumulates the power transmitted to the double roller 106 from the escapement mechanism 102, and serves to transmit this power to the balance staff 103 and the balance wheel 104.

(Escapement Mechanism)

Figure 10:
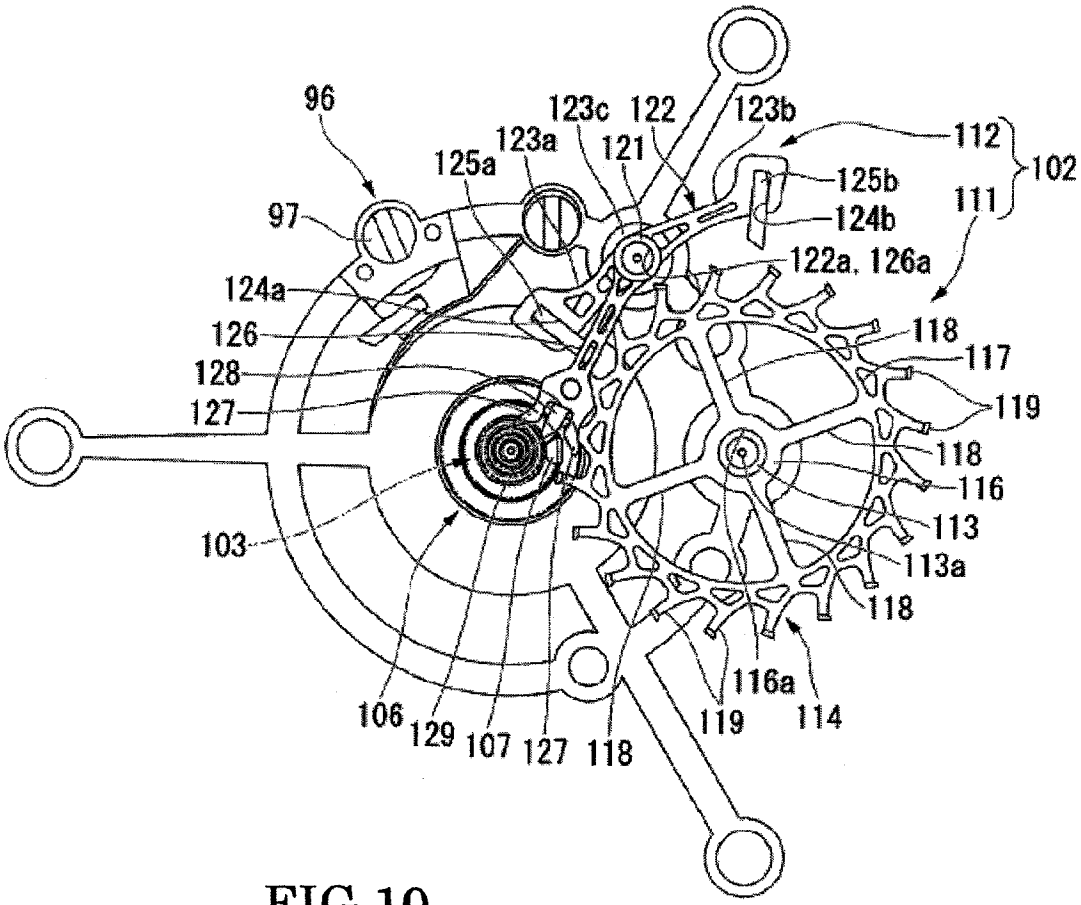
FIG. 10 is a plan view of an escapement mechanism according to the first embodiment of the present invention.

FIG. 10 is a plan view of the escapement mechanism 102.

As shown in FIGS. 3 and 10, the escapement mechanism 102 is equipped with an escape wheel & pinion 111, and a pallet fork 112 causing this escape wheel & pinion 111 to escape and regularly rotate.

The escape wheel & pinion 111 is equipped with a shaft body 113, and an escape wheel portion 114 fitted onto the shaft body 113.

At both ends of the shaft body 113, there are integrally formed a first cog portion 113*a* and a second cog portion 113*b* each reduced in diameter stepwise. The shaft body 113 is inserted into the shaft body insertion portion 131 of the support bar 95, and the first cog portion 113*a* is rotatably supported by the hole jewel 143 of the escapement mechanism holder 134, whereas the second cog portion 113*b* is rotatably supported by the hole jewel 137 of the bearing portion 133.

An escape pinion portion 115 is integrally formed on the bearing seat 136 side of the bearing portion 133 of the shaft body 113. Here, the inner diameter of the support bar 95 provided with the escapement mechanism bearing unit 130 is set to be substantially the same as the outer diameter of the toothed portion 31*d* of the stationary wheel 31, so that the escape pinion portion 115 is brought into mesh with this toothed portion 31*d*.

As shown in detail in FIG. 10, the escape wheel portion 114 is a member formed, for example, of a metal material or a material exhibiting a crystal orientation such as a single crystal silicon; it is formed by the LIGA (Lithographie Galvanoformung Abformung) process, DRIE (Deep Reactive Ion Etching), MIM (Metal Injection Molding), etc. utilizing electrocasting or an optical method such as photolithography.

The escape wheel portion 114 has a substantially annular hub portion 116 forced into the shaft body 113. The shaft body 113 is forced into the through-hole 116*a* formed in this hub portion 116. And, the hub portion 116 exists in the gap S2 between the support bar 95 and the escapement mechanism holder 134.

On the radially outer side of the hub portion 116, there is provided a rim portion 117 formed in a ring-like configuration so as to surround this hub portion 116. The rim portion 117 and the hub portion 116 are connected together by a plurality of (four in this embodiment) spoke portions 118. The spoke portions 118 extend along the radial direction, and are arranged at equal peripheral intervals.

Further, at the outer peripheral edge of the rim portion 117, there are formed a plurality of (20 in this embodiment) tooth portions 119 formed in a special, hook-like configuration so as to protrude radially outwards. Pawl jewels 125*a* and 125*b* of a pallet fork 112 described below are engaged with and released from the distal ends of these tooth portions 119.

As shown in FIGS. 8 through 10, the pallet fork 112 is equipped with a pallet staff 121, a body of pallet fork 122 fitted onto the pallet staff 121, and a pallet arbor 126.

The pallet staff 121 is a shaft member rotatably supported by a hole jewel 132*b* provided in the support bar 95 and by a hole jewel 144 provided in the escapement holder 134.

The body of pallet fork 122 is formed by connecting two pallet beams 123*a* and 123*b* formed, for example, by electrocasting; an insertion hole 122*a* allowing insertion of the pallet staff 121 is formed at a connection portion 123*c* of the two pallet beams 123*a* and 123*b*. And, the two pallet beams 123*a* and 123*b* extend in opposite directions from the connection portion 123*c*.

The electrocasting metal forming the body of pallet fork 122 may, for example, be chromium, which is of high hardness, nickel, iron, and an alloy containing these metals.

At the distal ends of the two pallet beams 123*a* and 123*b*, there are respectively formed slits 124*a* and 124*b* so as to be open on the escape wheel & pinion 111 side. Pallets 125*a* and 125*b* are respectively fixed to the slits 124*a* and 124*b* by adhesive or the like. The pallets 125 are substantially rectangular ruby prisms; and they protrude from the distal ends of the pallet beams 123*a* and 123*b* toward the tooth portions 119 of the escape wheel portion 114.

On the other hand, the pallet arbor 126 is also formed, for example, by electrocasting; at the proximal end thereof, there is formed an insertion hole 126*a* allowing insertion of the pallet staff 121. And, it is inserted into and fixed to the pallet staff 121 by being inserted from the escapement mechanism holder 134 side of the body of pallet fork 122. The pallet arbor 126 is formed so as to extend from the pallet staff 121 toward the balance staff 103 side.

At the distal end of the pallet arbor 126, there are provided a pair of entry horns 127, and a guard pin 128 arranged between the pair of entry horns 127. And, on the inner side of the pair of entry horns 127, there is formed a pallet box 129 to be engaged and disengaged with and from the impulse pin 107 of the balance with hairspring 101.

(Operation of Tourbillon with Constant-Force Device)

Next, the operation of the tourbillon 30 with a constant-force device will be described.

First, the operation of the balance with hairspring 101 and the escapement mechanism 102 mounted in the inner carriage 34 will be described with reference to FIGS. 8 through 10. The balance with hairspring 101 receives the rotational force of the escape wheel & pinion 111 via the impulse pin 107, and makes free oscillation due to the rotational force and the spring force of the hairspring 105. As a result of the free oscillation of the balance with hairspring 101, the pallet arbor 126 forming the pallet box 129 which can be engaged with and disengaged from the impulse pin 107 swings laterally around the pallet staff 121.

And, the body of pallet fork 122 fixed to the pallet staff 121 also swings integrally with the pallet arbor 126. As a result of the swinging of the body of pallet fork 122, the two pallets 125*a* and 125*b* alternately and repeatedly come into contact with the toothed portion 119 of the escape wheel portion 114. As a result, the escape wheel & pinion 111 constantly rotates at a fixed speed.

Figure 11:
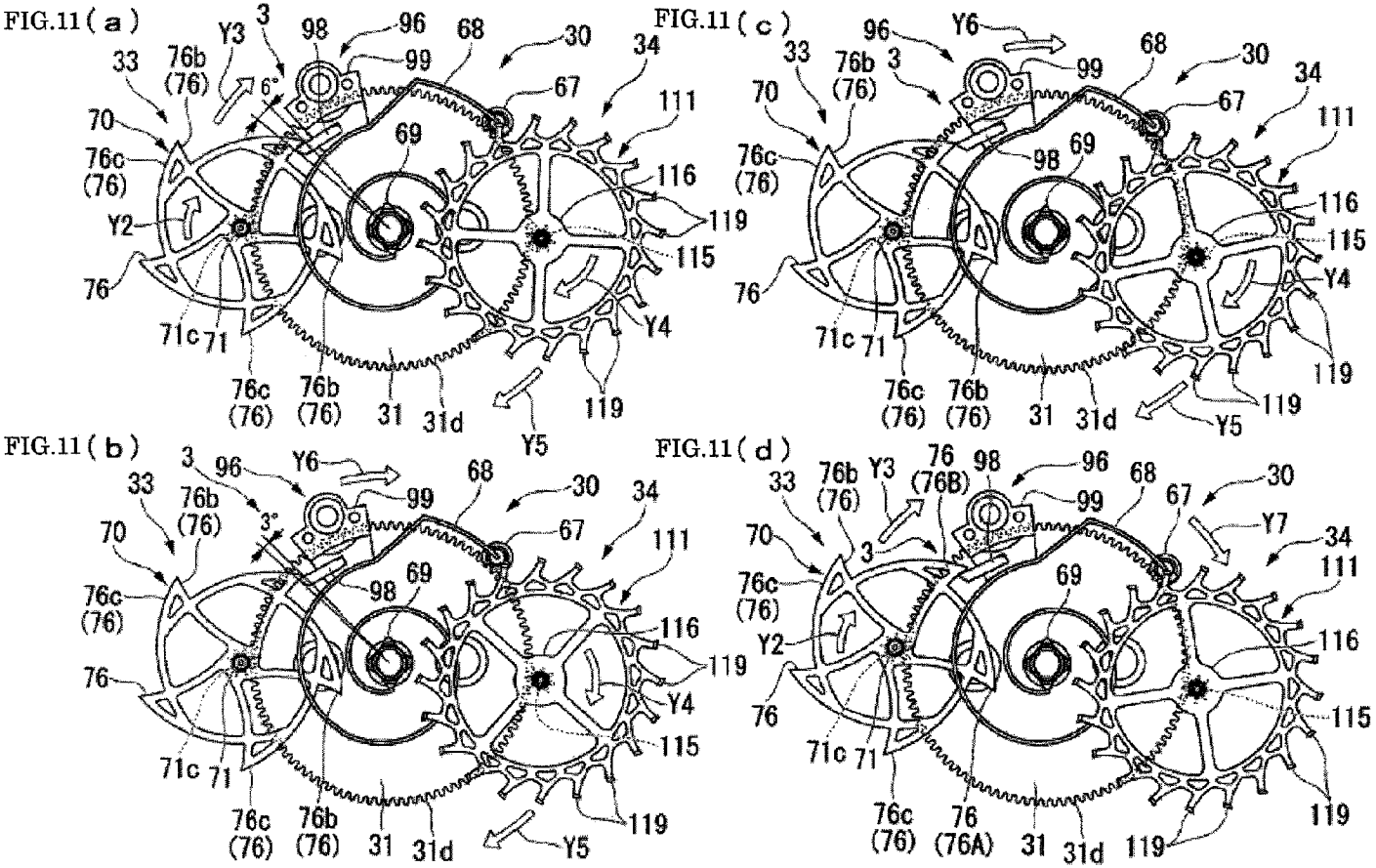
FIG. 11 is an explanatory view illustrating the operation of a stop wheel, a stopper 96, and an escape wheel & pinion according to the first embodiment of the present invention, with portions (a) through (d) illustrating changes with passage of time.

Subsequently, the operation of the outer carriage 33 and the inner carriage 34 will be described with reference to FIGS. 11 and 12. FIGS. 11(*a*) through 11(*d*) are diagrams illustrating the operation of the stop wheel 70 provided in the outer carriage 33 and of the stopper 96 and the escape wheel & pinion 111 provided in the inner carriage 34.

First, the rotational force that the outer carriage 33 receives, and the operation of the stop wheel 70 that receives this rotational force will be described.

In the outer carriage 33, the external gear portion 41 is in mesh with the fifth wheel & pinion 28, so that the rotational force of the movement barrel 22 is transmitted to the outer carriage 33 via the front train wheel. Further, in the stop wheel 70, the stop pinion portion 71*c* is in mesh with the toothed portion 31*d* of the stationary wheel 31. Thus, when the outer carriage 33 rotates, the stop wheel 70 revolves around the stationary wheel 31 (clockwise in FIG. 11(*a*), see an arrow Y3) while rotating around the axis of the stop pinion portion 71*c* (clockwise in FIG. 11(*a*), see an arrow Y2).

Next, the rotational force that the inner carriage 34 receives, and the operation of the escape wheel & pinion 111 that receives this rotational force will be described.

The inner carriage 34 is rotatably supported with respect to the outer carriage 33, and is connected to the outer carriage 33 via the constant-force sprig 68. Thus, the inner carriage rotates with respect to the outer carriage 33 upon receiving the urging force of the constant-force spring 68. Further, regarding the escape wheel & pinion 111, the escape pinion portion 115 is in mesh with the toothed portion 31*d* of the stationary wheel 31. Thus, when the inner carriage 34 rotates, the escape wheel & pinion 111 revolves around the stationary wheel 31 (clockwise in FIG. 11(*a*), see an arrow Y5) while rotating around the axis of the escape wheel & pinion 111 (clockwise in FIG. 11(*a*), see an arrow Y4).

Here, the escape wheel & pinion 111 constitutes the escapement mechanism 102, and is rotates constantly at a fixed speed due to the pallet fork 112 and the balance with hairspring 101. That is, the escape wheel & pinion 111 rotates at a fixed speed, whereby the inner carriage 34 rotatably supporting the escape wheel & pinion 111 rotates at a fixed speed. More specifically, the escape wheel & pinion 111 rotates at a fixed speed such that the inner carriage 34 makes one rotation per minute. In other words, the inner carriage 34 rotates by 6 degrees per second. The inner carriage 34 makes one rotation per minute, whereby the center wheel & pinion 25 makes one rotation per hour.

Here, the hook portion 76 of the stop wheel 70 and the pawl portion 98 of the stopper 96 are engaged with and released from each other repeatedly.

As shown in FIG. 11(*a*), in initial state in which the hook portion 76 of the stop wheel 70 and the pawl portion 98 of the stopper 96 are engaged with each other (hereinafter, this initial state will be referred to as point 0s), the range of the hook portion 76 corresponding to rotation by 6 degrees around the rotation axis of the outer carriage 33 and of the inner carriage 34 is engaged with the pawl portion 96. The rotation by 6 degrees corresponds to the angle by which the inner carriage 34 rotates per second.

At this point 0s, the rotation of the stop wheel 70 is regulated by the stopper 96, so that the outer carriage 33 is at rest. And, due to the urging force of the constant-force spring 68, solely the inner carriage 34 rotates. As a result of the rotation of the inner carriage 34, the escape wheel & pinion 111 continues to rotate.

Subsequently, as shown in FIG. 11(*b*), when 0.5 seconds elapse from point 0s, the inner carriage 34 rotates by 3 degrees. And, the stopper 96 fixed to the inner carriage 34 also moves integrally with the inner carriage 34 (clockwise in FIG. 11(*b*), see an arrow Y6). Thus, the pawl portion 98 of the stopper 96 slide-moves in the releasing direction on the front side 76*b* of the hook portion 76. And, the range of the hook portion 76 corresponding to rotation by 3 degrees around the rotation axis of the outer carriage 33 and of the inner carriage 34 is engaged with the pawl portion 98.

Subsequently, as shown in FIG. 11(*c*), immediately before one second elapses from point 0s, that is, when approximately 0.99 seconds elapse, the pawl portion 98 further slide-moves on the front side 76*b* of the hook portion 76, until there is attained the state immediately before the releasing of the engagement of the hook portion 76 and the pawl portion 98. And, the next instant, that is, when one second elapses, the engagement of the hook portion 76 and the pawl portion 98 is released.

Then, as shown in FIG. 11(*d*), the outer carriage 33 rotates, and, with this, the stop wheel 70 revolves around the stationary wheel 31 while rotating around the axis of the stop pinion portion 71*c*. In other words, the stop wheel 70 rotates while moving toward the stopper 96. And, the pawl portion 98 that has been engaged with the hook portion 76 (76A) at point 0s is engaged with the next hook portion 76 (76B), and the stop wheel 70 stops again.

When the engagement of the hook portion 76 and the pawl portion 98 is released, the stop wheel 70 rotates until it stops again; in this while, the outer carriage 33 rotates by 6 degrees.

Here, as a result of the rotation of the outer carriage 33, the stud 67 fixed to the outer carriage 33 also moves integrally with the outer carriage 33 (clockwise in FIG. 11(*d*), see an arrow Y7). As a result of the movement of the stud 67, the constant-force spring 68 is wound up. More specifically, the constant-force spring 68 is wound up by an amount corresponding to six rotations of the outer carriage 33.

And, with the constant-force spring 68 wound up, the outer carriage 33 (stop wheel 70) stops, and the inner carriage 34 rotates due to the urging force of the constant-force spring 68. By repeating this, the inner carriage 34 and the escape wheel & pinion ill continue to rotate at a fixed speed.

Thus, according to the above-described first embodiment, while the rotational movement of the outer carriage 33 is an intermittent movement, it is possible to smoothen the rotational operation of the inner carriage 34 in which the escapement mechanism 102 and the balance with hairspring 101 are mounted. As a result, the inertia of the inner carriage 34 is reduced, making it possible to prevent a shock from being applied to the balance with hairspring 101. Thus, it is possible to operate the balance with hairspring 101 in a stable manner while preventing a change in the oscillation cycle of the balance with hairspring 101 due to the direction of the gravitational force.

Further, since the escapement mechanism 102 and the balance with hairspring 101 are operated through the rotation of the inner carriage 34, it is possible to drive the inner carriage 34 efficiently, making it possible to reduce the power loss of the constant-force device 3.

Further, the tourbillon 30 with a constant-force device is rotatably supported with respect to the stationary wheel 31; further, it is provided with the outer carriage 33 and the inner carriage 34 capable of relative rotation, with the outer carriage 33 being provided with the stop wheel 70. In addition, the inner carriage 34 is provided with the stopper 96 for hindering or releasing the rotation of the stop wheel 70. And, as the outer carriage 33 rotates, the stop wheel 70 revolves around the stationary wheel 31 while rotating around the axis of the stop pinion portion 71*c*. On the other hand, the stopper 96 moves integrally with the inner carriage 34.

Thus, it is possible to hinder or release the rotation of the stop wheel 70 while rotating the stopper 96 integrally with the inner carriage 34, and, further, while rotating the stop wheel 70 integrally with the outer carriage 33. Thus, it is possible to reduce the power loss of the tourbillon 30 with a constant-force device.

Further, the tourbillon 30 with a constant-force device revolves the stop wheel 70 around the stationary wheel 31 while causing it to rotate, so that the stop wheel 70 is provided with a stop pinion portion 71*c*, and this stop pinion portion 71*c* is held in mesh with the toothed portion 31*d* of the stationary wheel 31. As a result, it is possible to engage and disengage the stop wheel 70 and the stopper 96 with and from each other in a simple structure. Thus, it is possible to achieve a reduction in the weight, size, and cost of the tourbillon 30 with a constant-force device.

Further, the front side 76*b* of the hook portion 76 of the stop gear 72 is formed in an arcuate configuration, and the center of the arc is set to be coaxial with the rotation center of the outer carriage 33. That is, the configuration of the front side 76*b* is the same as the movement path of the pawl portion 98 of the stopper 96 slide-moving on this side 76*b*. Thus, when the pawl portion 98 slide-moves on the side 76*b*, no excessive load is applied to the stop gear 72.

That is, when, for example, the hook portion 76 protrudes farther in front of the rotational direction Y1 (See FIG. 6) of the outer carriage 33 than in the above first embodiment, it is necessary to provide a force pushing back the stop gear 72 in the reverse direction when slide-moving the pawl portion 98 in the releasing direction.

Thus, by forming the front side 76*b* of the hook portion 76 in an arcuate configuration, and by setting the center of the arc to be coaxial with the rotation center of the outer carriage 33, no excessive load is applied to the stop gear 72, making it possible to improve the operational efficiency of the tourbillon 30 with a constant-force device.

The surface of the pawl portion 98 coming into contact with the side 76*b* of the hook portion 76 may be formed in an arcuate configuration like the side 76*b*. Due to this construction, the hook portion 76 and the pawl portion 98 are brought into face abutment with each other, making it possible to prevent high local pressure from being applied to the hook portion 76 and the pawl portion 98. As a result, it is possible to increase the service life of the stop gear 72 and of the pawl portion 98.

First Modification of the First Embodiment

Next, a first modification of the first embodiment will be described with reference to FIGS. 12 and 13.

Figure 12:
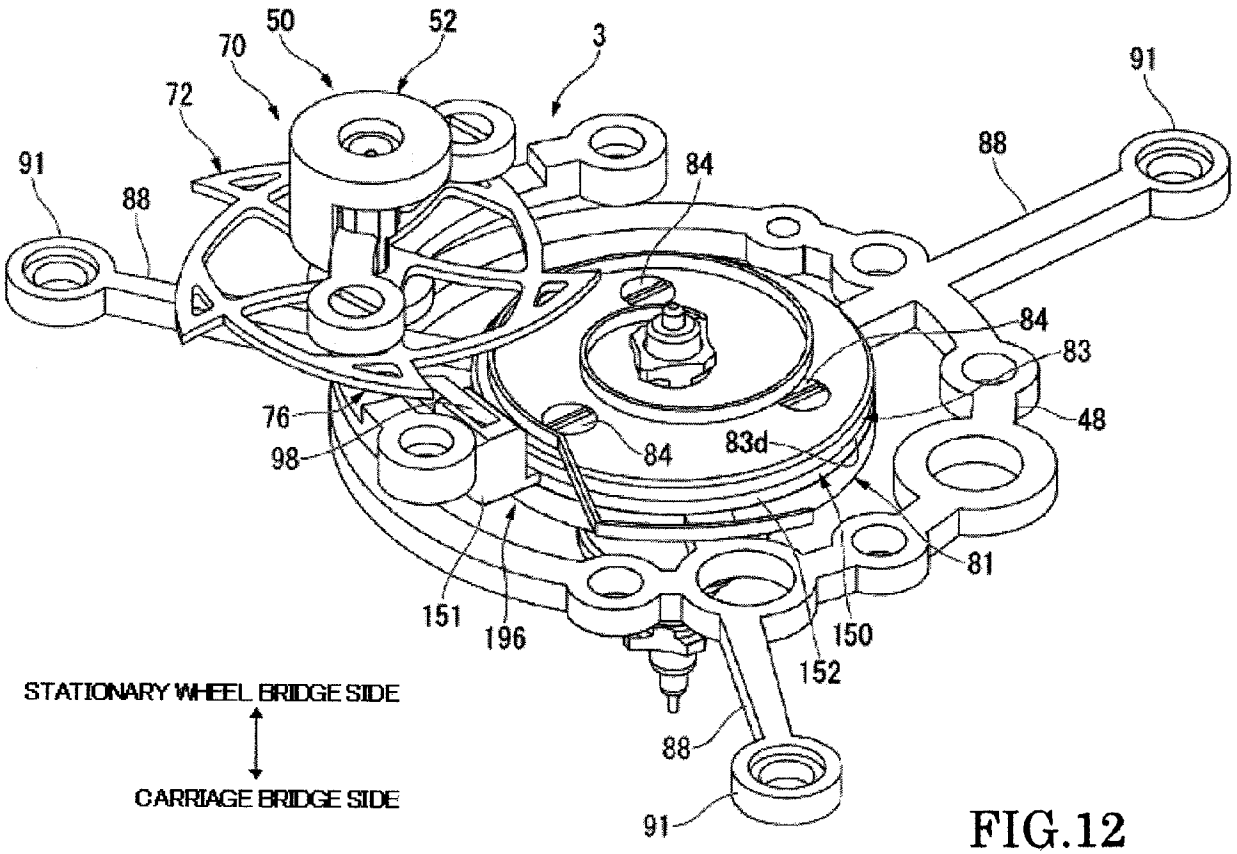
FIG. 12 is a perspective view, as seen from the stationary wheel bridge side, of a main portion of a first variation of the first embodiment according to the present invention.
Figure 13:
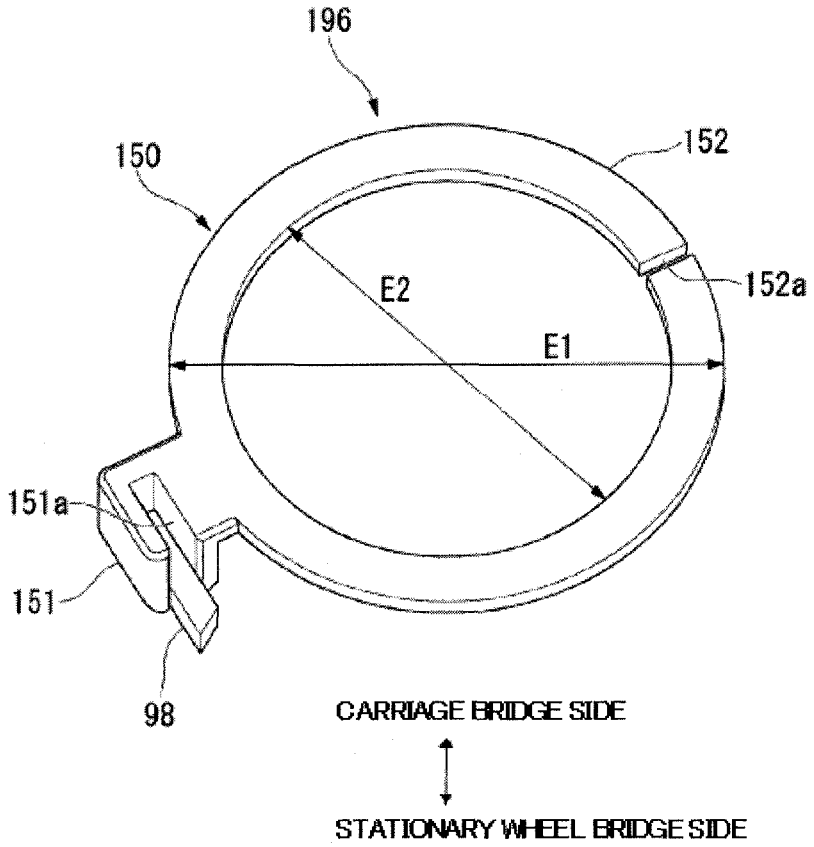
FIG. 13 is a perspective view of a stopper of the first variation of the first embodiment according to the present invention.

FIG. 12 is a perspective view, as seen from the stationary wheel bridge 29 side, of a part of the inner carriage 34 of the first modification of the first embodiment, and the stop wheel 70 provided in the outer carriage 33, and FIG. 13 is a perspective view of a stopper 196 according to the first modification of the first embodiment. The components that are the same as those of the first embodiment described above are indicated by the same reference numerals, and a description thereof will be left out (This also applies to the second modification of the first embodiment and to the second embodiment).

As shown in FIGS. 12 and 13, the first modification of the first embodiment differs from the first embodiment in that the configuration of the stopper 96 of the first embodiment differs from that of the stopper 196 of the first modification of the first embodiment.

More specifically, the stopper 196 is composed of the pawl portion 98 coming into contact with the hook portion 76 of the stop wheel 70, and a support portion 150 supporting the pawl portion 98. A support portion 199 is composed of a pawl holder 151 of a substantially rectangular configuration retaining the pawl portion 98, and a ring-like fixing portion 152 integrally formed on one side of the pawl holder 151.

The paw holder 151 has a pawl accommodation recess 151*a* so that the stop wheel 70 side may be open, and the pawl portion 98 is accommodated therein.

And, the stopper 196 is fixed in position, with the fixing portion 152 being held between a first inner carriage bearing portion 81 and a first inner rotary member 83. More specifically, in the stopper 196, the fixing portion 152 is arranged between the first inner carriage bearing portion 81 and the first inner rotary member 83. And, it is fixed in position, by fastening the first inner rotary member 83 to the first inner carriage bearing portion 81 by a screw 84.

Here, an outer diameter E1 of the fixing portion 152 is set to be substantially equal to the outer diameter of the first inner carriage bearing portion 81. Further, an inner diameter E2 of the fixing portion 152 is set such that the inner peripheral edge is situated radially on the outer side of the arrangement position of the screw 84. As a result, the fixing portion 152 does not interfere with the screw 84.

Further, a slit 152*a* is formed in the fixing portion 152, making it possible to adjust the manufacturing error of the outer diameter E1 and the inner diameter E2 of the fixing portion 152.

In this construction, when fixing the stopper 196, the screw 84 is temporarily fastened. And, fine adjustment is made on the peripheral position of the pawl holder 151, and the pawl holder 151 is set to a predetermined position before fastening the screw 84.

Due to this construction, in addition to the same effect as that of the first embodiment described above, it is possible to adjust the engagement amount of the stop gear 72 and the pawl portion 98 without changing the radial position where the stop gear 72 of the stop wheel 70 and the pawl portion 98 of the stopper 196 are engaged with each other.

Second Modification of the First Embodiment

Next, a second modification of the first embodiment will be described with reference to FIGS. 14 through 16.

Figure 14:
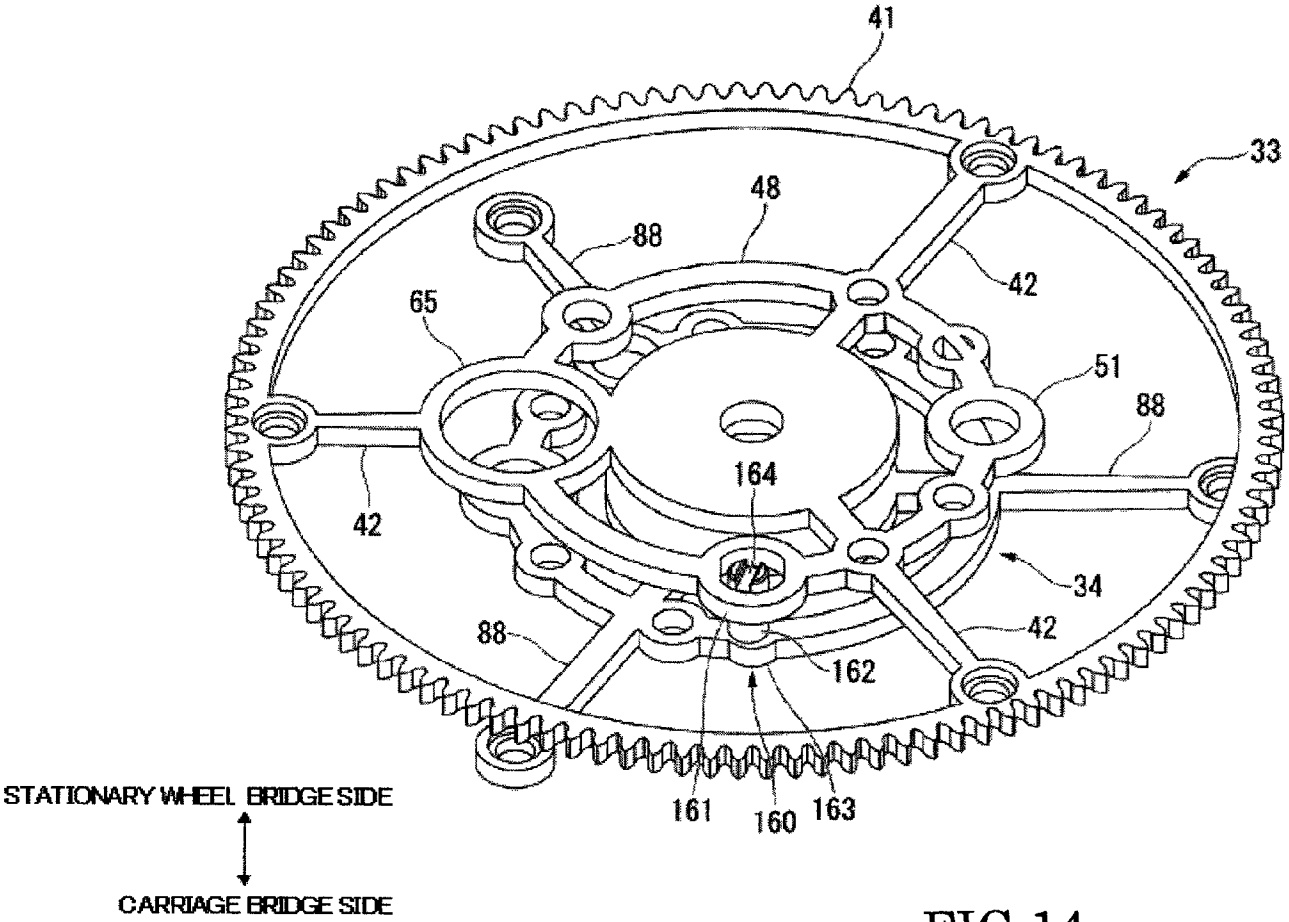
FIG. 14 is a perspective view, as seen from the stationary wheel bridge side, of a main portion of a second variation of the first embodiment according to the present invention.

FIG. 14 is a perspective view, as seen from the stationary wheel bridge 29 side, of a part of the outer carriage 33 of the second modification of the first embodiment, and of a part of the inner carriage 34 thereof.

As shown in the drawing, the difference between the first embodiment and the second modification of the first embodiment lies in the fact that solely in this second modification, there is provided a phase deviation regulation mechanism 160 suppressing the phase deviation of the outer carriage 33 and the inner carriage 34 within a predetermined angle.

The phase deviation regulation mechanism 160 is equipped with a regulation ring 161 integrally formed on the support bar 48 of the outer carriage 33, and an eccentric pin 162 provided on the support bar 95 of the inner carriage 34 and inserted into the regulation ring 161.

The regulation ring 161 is arranged between the bearing unit insertion portion 65 and the shaft body insertion portion 51 on the support bar 48. On the other hand, the support bar 95 of the inner carriage 34 integrally has, at a position axially opposite the regulation ring 161, a disc-like pin fixing portion 163. The eccentric pin 162 is fixed to the pin fixing portion 163 so as to protrude toward the regulation ring 161.

Figure 15:
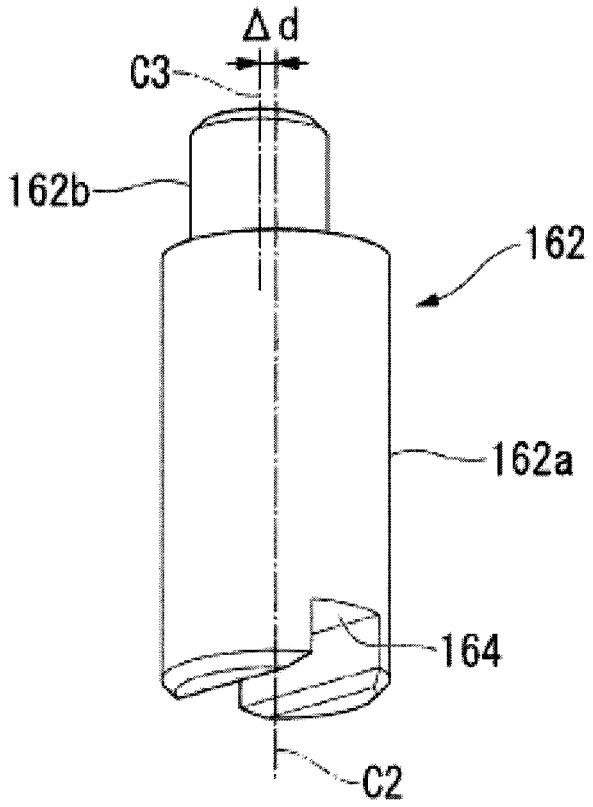
FIG. 15 is a perspective view of an eccentric pin of the second variation of the first embodiment according to the present invention.
Figure 16:
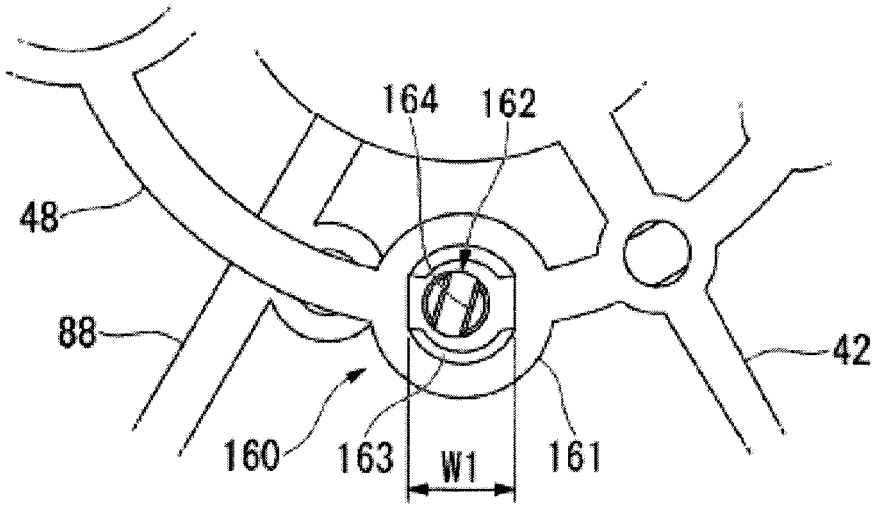
FIG. 16 is a plan view of a phase deviation regulation mechanism in the second variation of the first embodiment according to the present invention.

FIG. 15 is a perspective view of the eccentric pin 162, and FIG. 16 is a plan view of the phase deviation regulation mechanism 160.

As shown in FIG. 15, the eccentric pin 162 is composed of a pin main body 162*a*, and a fixing pin 162*b* integrally formed at the proximal end of the pin main body 162*a*. And, by forcing the fixing pin 162*b* into the pin fixing portion 163 of the inner carriage 34, the eccentric pin 162 is fixed to the inner carriage 34. Here, the forcing-in is a so-called light forcing-in, and is effected to a degree that the eccentric pin 162 can be rotated around the axis of the fixing pin 162*b*.

Here, the axis C2 of the pin main body 162*a* and the axis C3 of the fixing pin 162*b* are deviated from each other by Δd. Further, at the distal end of the pin main body 162*a*, there is formed a recess 164 along the radial direction, and it is possible to rotate the eccentric pin 162 by using, for example, a flat-tipped driver.

On the other hand, as shown in FIG. 16, two-way taking shape is effected on both sides in the peripheral direction on the inner peripheral surface of the regulation ring 161. A width W1 of the two-way taking shape is set such that the inner carriage 34 rotates with respect to the outer carriage 33, and that when the eccentric pin 162 abuts the inner peripheral surface of the regulation ring 161, the rotational angle of the inner carriage 34 with respect to the outer carriage 33 is within a predetermined angle. It is desirable for this predetermined angle to be, for example, 6 degrees. Six degrees is an angle at which the engagement of the stop gear 72 of the stop wheel 70 and the pawl portion 98 of the stopper 96 is released (one second in time); it is enough to secure a rotational angle of the inner carriage 34 with respect to the outer carriage 33 by an amount corresponding to six degrees.

Here, by rotating the eccentric pin 162, it is possible to adjust the deviation amount in the peripheral direction of the axis C2 of the pin main body 162*a* and the axis C3 of the fixing pin 162*b*. Thus, even when a manufacturing error is generated in the regulation ring 161, it is possible to adjust the rotation regulation amount of the inner carriage 34 with respect to the outer carriage 33 with high accuracy by rotating the eccentric pin 162.

Thus, in the second modification of the first embodiment described above, in addition to the same effects as those of the first embodiment, even if a disturbance is applied to the mechanical timepiece 1 when, for example, the timepiece is dropped, it is possible to prevent the inner carriage 34 from rotating to a degree more than necessary with respect to the outer carriage 33. Thus, it is possible to prevent, for example, the constant-force spring 68 from being completely unwound, making it possible to reliably stabilize the operation of the tourbillon 30 with a constant-force device.

In the second modification of the first embodiment described above, the regulation ring 161 is arranged between bearing unit insertion portion 65 on the support bar 48 and the shaft body insertion portion 51. This, however, should not be construed restrictively; and the position of the regulation ring 161 can be set to an arbitrary position on the support bar 48. Further, the position of the eccentric pin 162 can be set to an arbitrary position according to the position of the regulation ring 161.

Further, in the first embodiment described above, the front side 76*b* of the hook portion 76 of the stop wheel 70 is formed in an arcuate configuration, and the center of the arc is set to the rotation center of the outer carriage 33 in the first embodiment, and is set coaxially with respect to a shaft body 231 in the second embodiment. This, however, should not be construed restrictively; it is only necessary for the front side to be formed in a configuration allowing engagement and releasing with respect to the pawl portion 98 of the stopper 96.

Second Embodiment

Next, the second embodiment will be described with reference to FIGS. 17 through 22.

Figure 17:
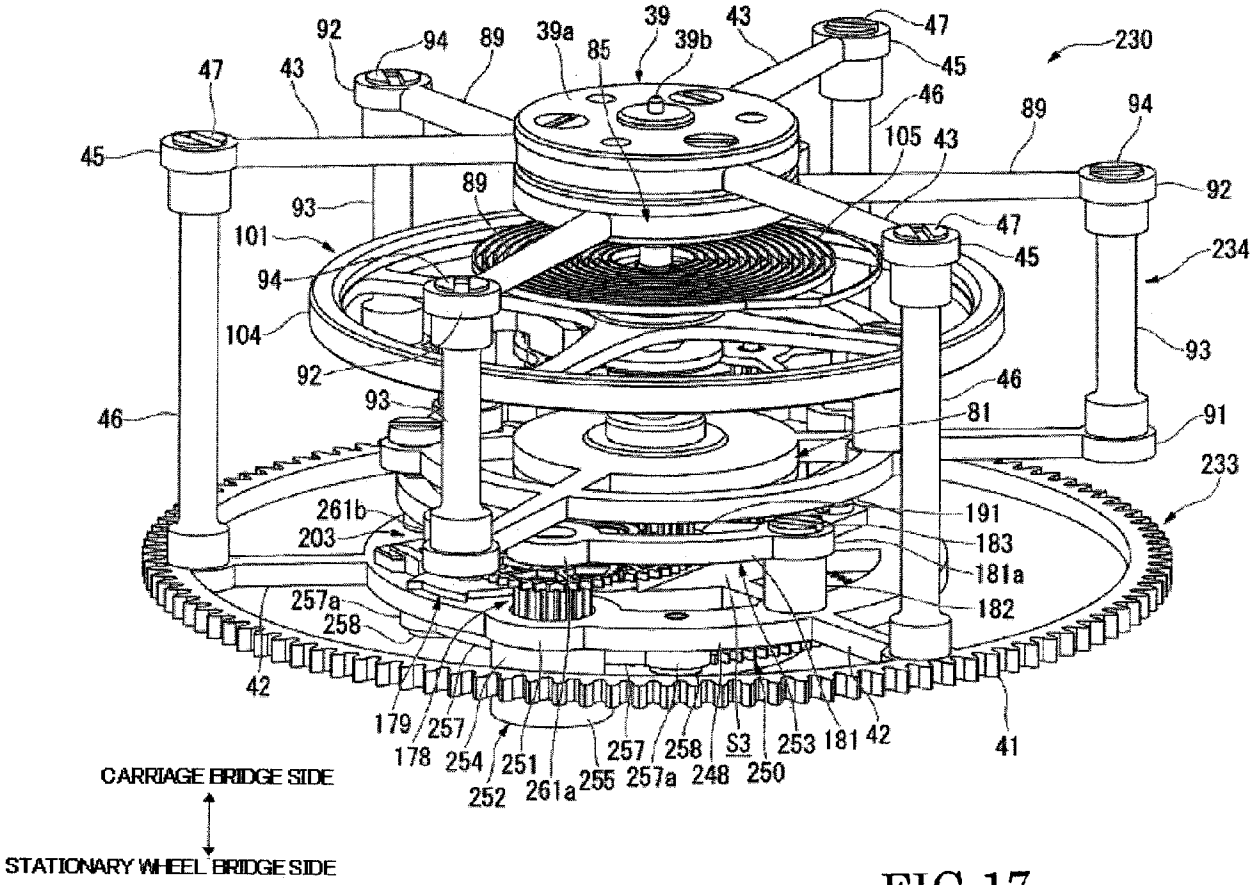
FIG. 17 is a perspective view of a tourbillon with a constant-force device in a second embodiment according to the present invention.
Figure 18:
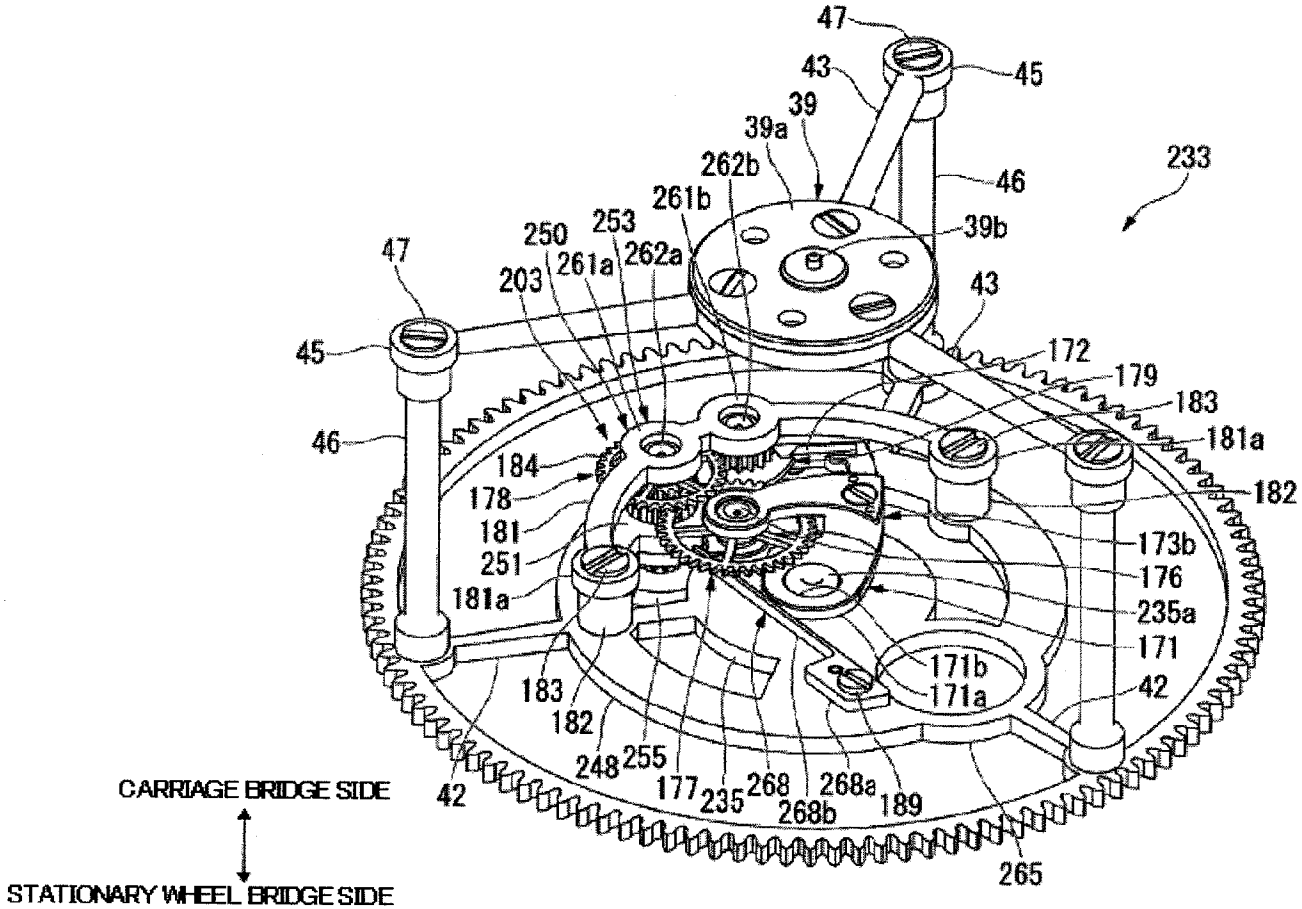
FIG. 18 is a perspective view of an outer carriage in the second embodiment according to the present invention.
Figure 19:
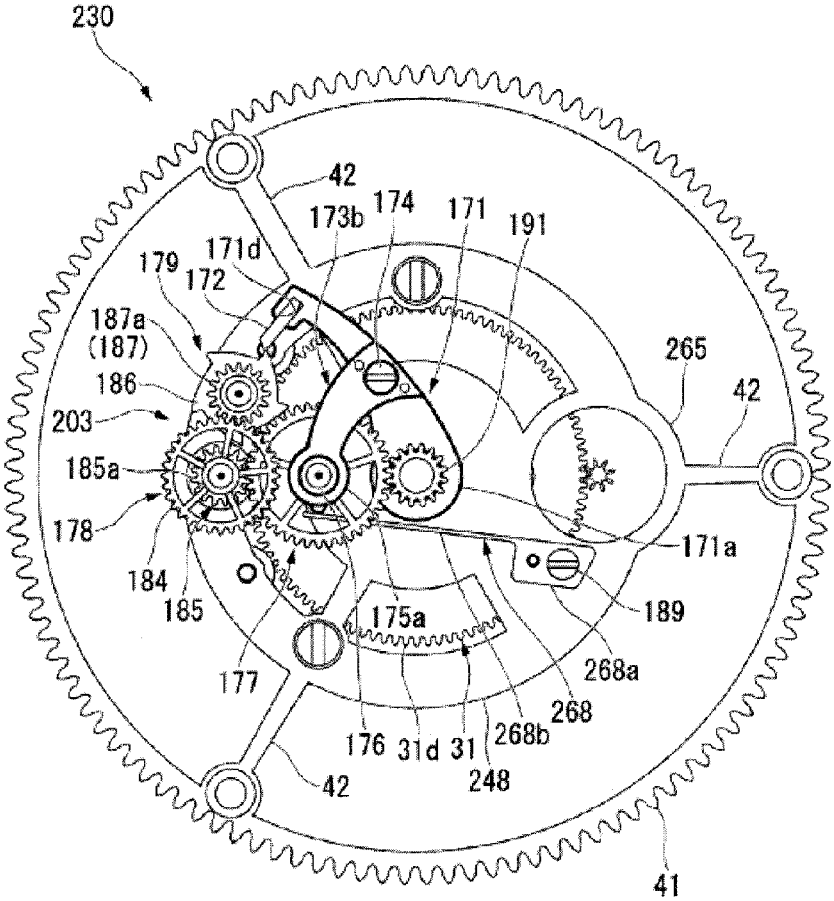
FIG. 19 is a plan view of a constant-force device in the second embodiment according to the present invention.
Figure 20:
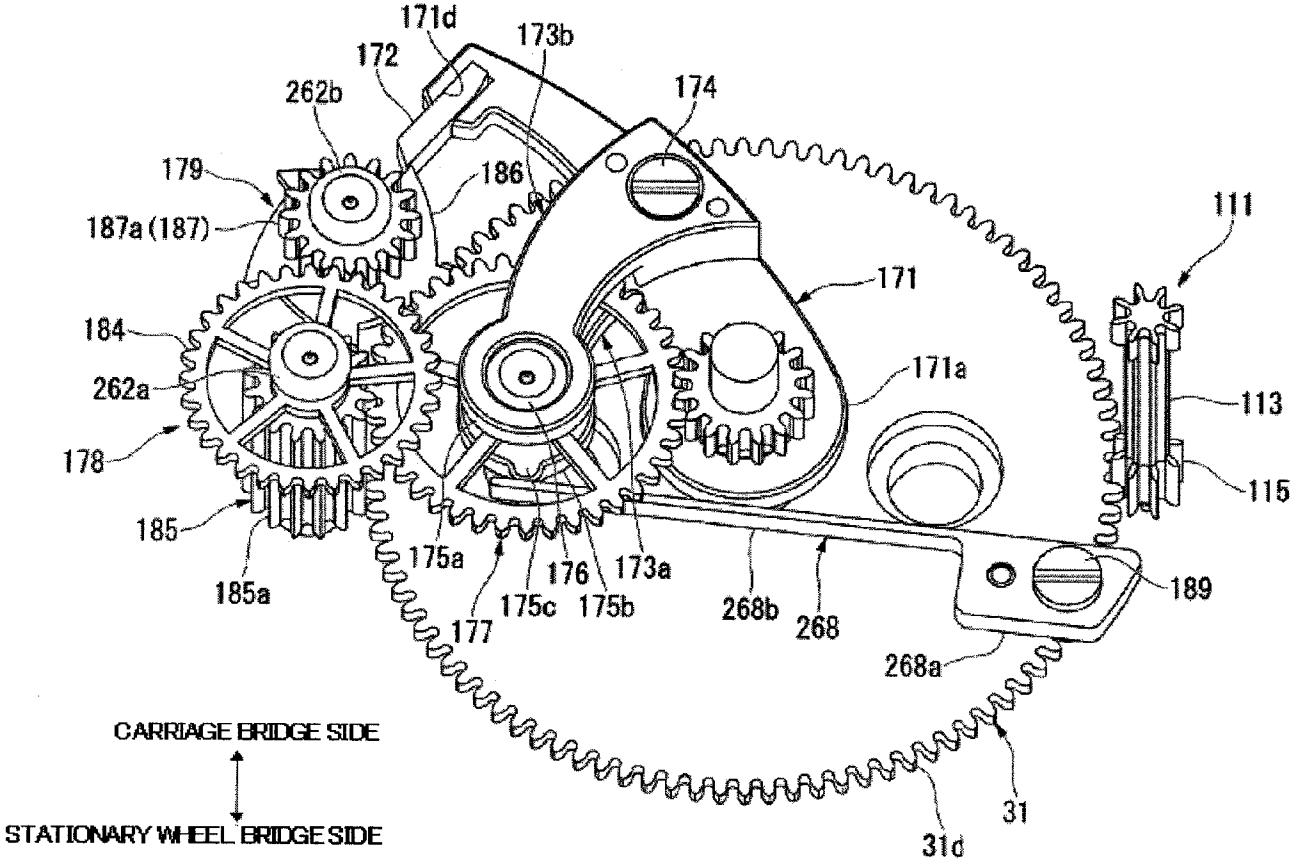
FIG. 20 is a perspective view of the constant-force device in the second embodiment according to the present invention.
Figure 21:
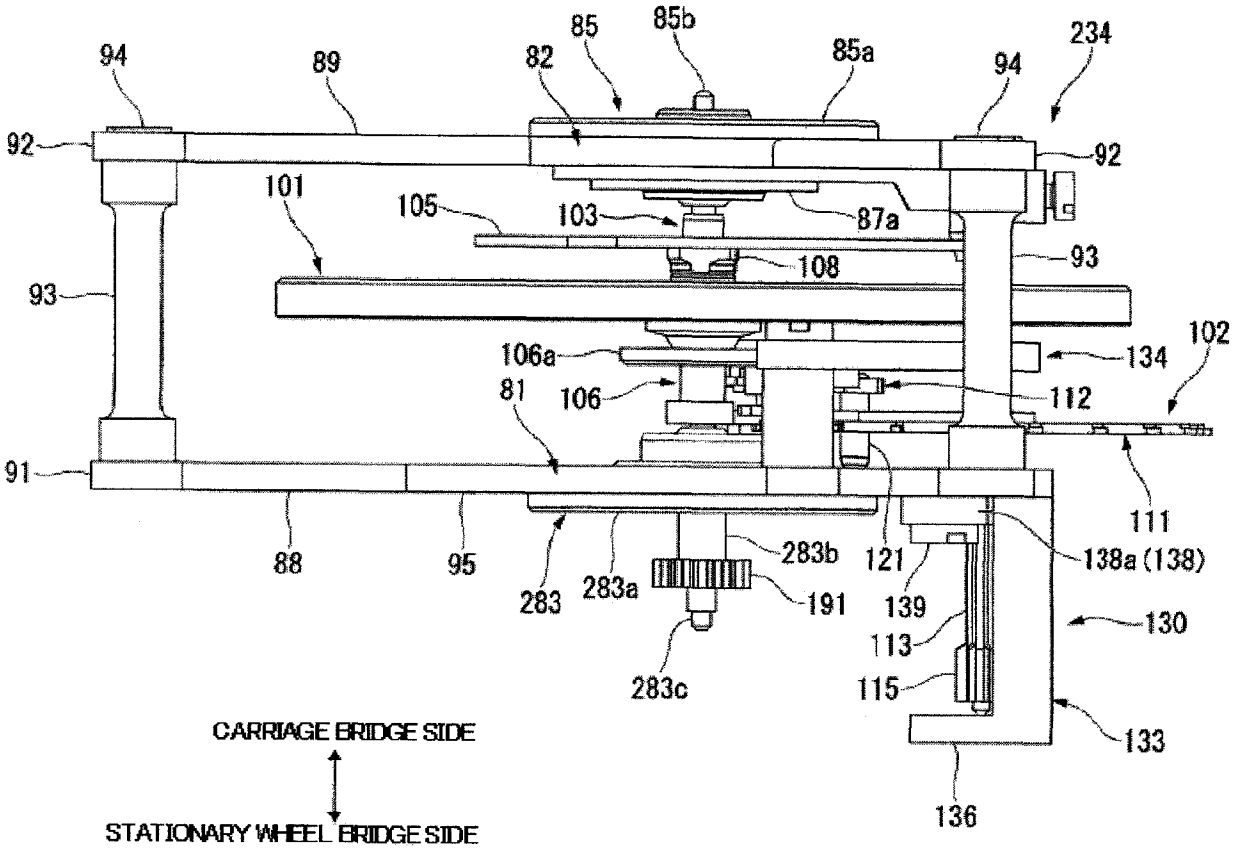
FIG. 21 is a side view of an inner carriage in the second embodiment according to the present invention.

FIG. 17 is a perspective view of a tourbillon 230 with a constant-force device according to the second embodiment, FIG. 18 is a perspective view of an outer carriage 233 according to the second embodiment, FIG. 19 is a plan view of a constant-force device 203 according to the second embodiment, FIG. 20 is a perspective view of the constant-force device 203 of the second embodiment, and FIG. 21 is a side view of an inner carriage 234 according to the second embodiment.

In FIGS. 17, 18, 20, and 21, the lower side is the stationary wheel bridge 29 side, and the upper side is the carriage bridge 32 side. In FIGS. 17 through 21, the stationary wheel bridge 29 and the carriage bridge 32 are omitted.

As shown in FIGS. 17 through 21, the difference between the first embodiment and the second embodiment lies in the difference between the constant-force device 3 of the first embodiment and the constant-force device 203 of the second embodiment.

More specifically, as shown in detail in FIGS. 18 through 20, the outer carriage 233 of the tourbillon 230 with a constant-force device has, substantially at the center in the radial direction of the first outer carriage bearing portion 235, a hole jewel 235*a* for rotatably supporting the inner carriage 234, and, at the same time, a stopper lever 171 constituting the constant-force device 203 is rotatably supported.

The stopper lever 171 is formed so as to extend while slightly curving from substantially the center in the radial direction toward the outer side in the radial direction of the first outer carriage bearing portion 235. The proximal end portion 171*a* of the stopper lever 171 is formed in a substantially disc-like configuration, and this proximal end portion 171*a* is rotatably supported by the first outer carriage bearing portion 235.

Further, the proximal end portion 171*a* has an insertion hole 171*b* allowing insertion of a shaft portion 283*b* (See FIG. 21) of a first inner rotary member 283 of the inner carriage 234. The hole jewel 235*a* of the first carriage bearing portion 235 is exposed via the insertion hole 171*b*.

Further, the stopper lever 171 is formed so as to be gradually tapered toward the distal end. And, at the distal end 171*c*, there is formed a slit 171*d* open in the peripheral direction, and a pawl portion 172 is mounted to this slit 171*d*. The pawl portion 172 protrudes along the peripheral direction from the distal end portion 171*c* of the stopper lever 171.

Further, substantially at the center in the longitudinal direction of the stopper lever 171, a first arm 173*a* is formed integrally. Further, substantially at the center in the longitudinal direction of the stopper lever 171, there is arranged a second arm 173*b* so as to be in correspondence with the first arm 173*a*. The proximal end portion of the second arm 173*b* is fastened to the stopper lever 171 by a screw 174.

The arms 173*a* and 173*b* extend in the same direction as the protruding direction of the pawl portion 172 from substantially the center in the longitudinal direction of the stopper lever 171 and while curving along the peripheral direction. Further, the arms 173*a* and 173*b* are formed so as to be gradually tapered toward the distal ends thereof.

At the distal ends of the arms 173*a* and 173*b*, there are formed substantially disc-like bearing seats 175*a* and 175*b*. Hole jewels 176 are respectively provided at the bearing seats 175*a* and 175*b*. An inner carriage drive wheel 177 is rotatably supported by these hole jewels 176. A protrusion 175*c* is provided at the bearing seat 175*b* of the first arm 173*a*. The protrusion 175*c* is formed so as to protrude in the extending direction of the first arm 173*a*. The distal end of a constant-force spring 268 described below comes into contact with the protrusion 175*c*.

As shown in detail in FIGS. 17 and 18, around the first outer carriage bearing portion 235, there is provided a support bar 248 formed in a ring-like configuration so as to surround this first outer carriage bearing portion 235. The inner diameter of the support bar 248 is set to be substantially the same as the outer diameter of the toothed portion 31*d* of the stationary wheel 31.

The support bar 248 is provided with a stop wheel bearing unit 250, a stop wheel drive wheel 178 rotatably supported by this stop wheel bearing unit 250, and a stop wheel 179.

The stop wheel bearing unit 250 is composed of a ring-like shaft body insertion portion 251 integrally formed on the support bar 248, a hole jewel (not shown) provided nearer to the pawl portion 172 of the stopper lever 171 than this shaft body insertion portion 251, a first stop wheel bearing portion 252 mounted to the stationary wheel bridge 29 side of the support bar 248, and a second stop wheel bearing portion 53 mounted to the carriage bridge 32 side of the support bar 248.

The first stop wheel bearing portion 252 has a wall portion 254 extending toward the stationary wheel bridge 29 side from a position corresponding to the shaft body insertion portion 251 of the support bar 248. The wall portion 254 is formed in a substantially C-shaped sectional configuration so as to be open radially on the inner side. On the inner peripheral surface side of the distal end of the wall portion 254, there is integrally formed a substantially disc-like bearing seat 255 so as to be orthogonal to the wall portion 254. And, at the bearing seat 255, there is provided a hole jewel (not shown) for rotatably supporting the stop wheel drive wheel 178.

On the proximal end side of the wall portion 254, there are integrally formed a pair of mounting stays 257 extending on both sides with the wall portion 254 therebetween. At the distal ends of the pair of mounting stays 257, there are integrally formed substantially disc-like screw seats 257*a*. The screw seats 257*a* are fastened to the support bar 248 by screws 258.

On the other hand, the second stop wheel bearing portion 253 has a substantially disc-like bearing seat 261*a* arranged at a position corresponding to the shaft body insertion portion 251 formed in the support bar 248, and a substantially disc-like bearing seat 261*b* arranged nearer to the pawl portion 172 of the stopper lever 171 than the bearing seat 261*a*. These bearing seats 261*a* and 261*b* are respectively provided with hole jewels 262*a* and 262*b*. The hole jewel 262*a* of the bearing seat 261*a* rotatably supports the stop wheel drive wheel 178 in cooperation with the hole jewel of the first stop wheel bearing portion 252. On the other hand, the hole jewel 262*b* of the bearing seat 261*b* rotatably supports the stop wheel 179 in cooperation with a hole jewel (not shown) provided in the support bar 248.

The second stop wheel bearing portion 253 has a mounting stay 181 connecting the bearing seats 261*a* and 261*b*. The mounting stay 181 is formed so as to be substantially arcuate in plan view as seen in the axial direction so as to be in correspondence with the configuration of the support bar 248. At both ends of the mounting stay 181, there are integrally formed substantially disc-like screw seats 181*a*. The screw seats 181*a* are mounted to the support bar 248 via spacers 182. And, the screw seats 181*a* are fastened to the support bar 248 by screws 183.

Here, the second stop wheel bearing portion 253 is fixed to the support bar 248 via the spacers 182, so that there is formed a gap S3 between the support bar 248 and the second stop wheel bearing portion 253. In this gap S3, there are provided a drive gear 184 of the stop wheel drive wheel 178 and a stop wheel 179.

As shown in detail in FIGS. 18 through 20, apart from the drive gear 184, the stop wheel drive wheel 178 has a drive wheel shaft body 185 inserted into the shaft body insertion portion 251 formed in the support bar 248. At both ends of the drive wheel shaft body 185, there are integrally formed cog portions (not shown). These cog portions are respectively rotatably supported by a hole jewel (not shown) of the first stop wheel bearing portion 252 and a hole jewel 262*a* of the second stop wheel bearing portion 253.

On the outer peripheral surface of the drive wheel shaft body 185, there is integrally formed a drive wheel pinion portion 185*a*. Here, the inner diameter of the support bar 248 on which the stop wheel bearing unit 250 is provided is set to be substantially equal to the outer diameter of the toothed portion 31*d* of the stationary wheel 31, so that the drive wheel pinion portion 185*a* is held in mesh with this toothed portion 31*d*. The drive wheel pinion portion 185*a* is also held in mesh with the inner carriage drive wheel 177.

On the other hand, the drive gear 184 is fitted onto the second stop wheel bearing portion 253 side end portion of the drive wheel shaft body 185, and the drive wheel shaft body 185 and the drive gear 184 are integrated so as to be incapable of relative rotation. The drive gear 184 is held in mesh with the stop pinion portion 187*a* constituting the stop wheel 179.

The stop wheel 179 has a stop gear 186 and a stop wheel shaft body 187. And, the stop pinion portion 187*a* is integrally formed on the outer peripheral surface of the stop wheel shaft body 187. At both ends of the stop wheel shaft body 187, there are integrally formed cog portions (not shown). These cog portions are respectively rotatably supported by a hole jewel (not shown) provided in the support bar 248 and the hole jewel 262*b* of the second stop wheel bearing portion 253.

Further, the stop gear 186 is fitted onto the support bar 248 side end portion of the stop wheel shaft body 187, and the stop wheel shaft body 187 and the stop gear 186 are integrated so as to be incapable of relative rotation. On the outer peripheral portion of the stop gear 186, there are formed a plurality of (e.g., five) hook portions 188 so as to extend radially outwards. The pawl portion 172 of the stopper lever 171 is engaged with and released from the hook portions 188.

Apart from this, the support bar 248 has, on the side radially opposite the shaft body insertion portion 251 of the first outer carriage bearing portion 235, a ring-like bearing unit insertion portion 265 integrally formed thereon. The bearing portion 133 of the escapement mechanism bearing unit 130, which is provided in the inner carriage 234, is inserted into this bearing unit insertion portion 265.

Further, the support bar 248 is provided with a constant-force spring 268 adjacent to the bearing unit insertion portion 265. The constant-force spring 268 serves to impart a rotational force to the inner carriage 234 with respect to the outer carriage 233. The constant-force spring 268 is integrally formed by a fixing portion 268*a* arranged adjacent to the bearing unit insertion portion 265 of the support bar 248, and a bar-like sprig main body 268*b* extending from this fixing portion 268*a* toward the bearing seat 175*b* of the first arm 173*a* provided on the stopper lever 171.

And, the fixing portion 268*a* is fastened to the support bar 248 by a screw 189. On the other hand, the spring main body 268*b* extends until its distal end reaches the bearing seat 175*b* of the first arm 173*a*, pressing a protrusion 175*c* protruding from the bearing seat 175*b*.

As shown in FIG. 21, the inner carriage 234 of the second embodiment is of the same basic construction as the first embodiment described above in that it has a substantially disc-like first carriage bearing portion 81 arranged on the stationary wheel bridge 29 side and a substantially disc-like second carriage bearing portion 82 arranged on the carriage bridge 32 side, in that there is provided a support bar 95 formed in a ring-like configuration so as to surround the periphery of the first inner carriage bearing portion 81, in that the escapement mechanism 102 and the balance with hairspring 101 are mounted therein, etc.

Here, the inner carriage 34 of the first embodiment described above and the inner carriage 234 of the second embodiment differ from each other in that the configuration of the first inner rotary member 83 provided on the first inner carriage bearing portion 81 of the first embodiment is different from the configuration of the first inner rotary member 283 provided in the first inner carriage bearing portion 81 of the second embodiment.

That is, the first inner rotary member 283 of the second embodiment is integrally formed by a base portion 283*a* formed in a substantially disc-like configuration, a shaft portion 283*b* protruding toward the first outer carriage bearing 235 side from substantially the center in the radial direction of the base portion 283*a*, and a cog portion 283*c* protruding from the distal end of the shaft portion 283*b* so as to be in correspondence with the configuration of the first inner carriage bearing portion 81.

The cog portion 283*c* is inserted into a hole jewel 235*a* of the first outer carriage bearing portion 235, whereby it is rotatably supported with respect to the outer carriage 233. The distal end side of the shaft portion 283*b* is formed so as to be reduced in diameter stepwise. And, an inner carriage pinion portion 191 is formed at the step portion. This inner carriage pinion portion 191 is held in mesh with an inner carriage drive wheel 177 provided on the outer carriage 233.

(Operation of the Tourbillon with Constant-Force Device)

Next, the operation of a tourbillon 230 with a constant-force device will be described with reference to FIG. 22.

Figure 22:
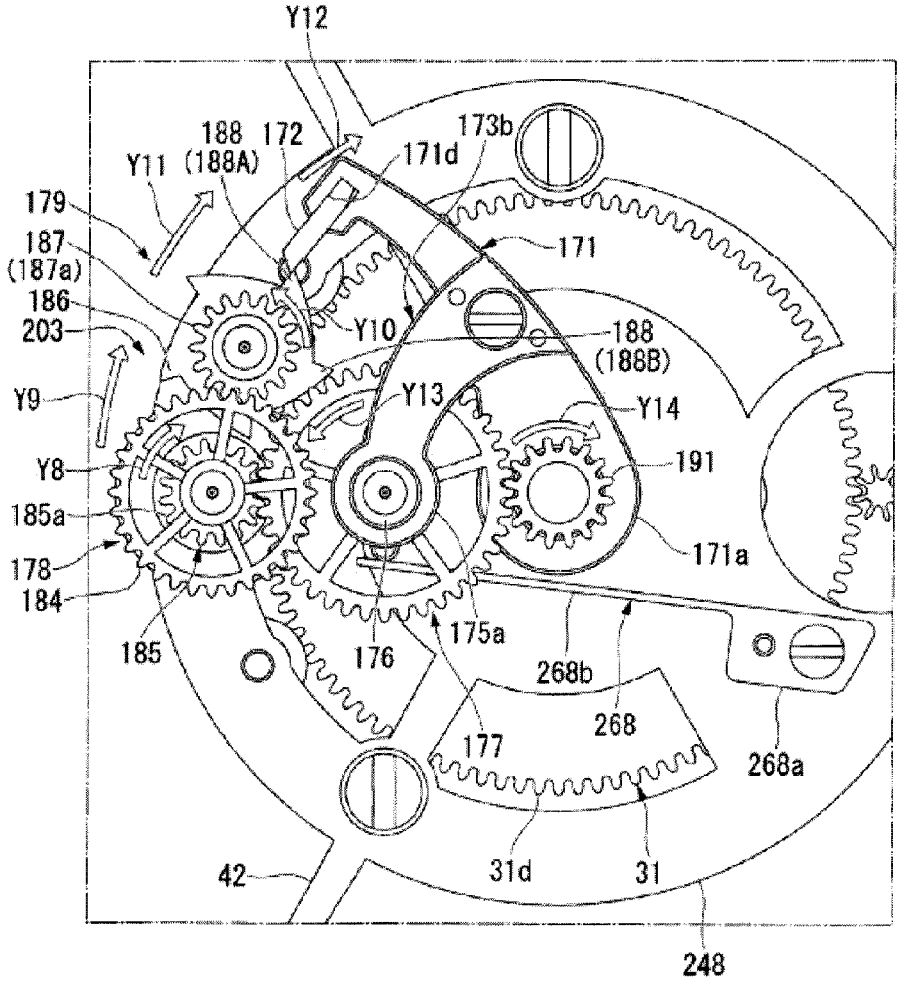
FIG. 22 is an explanatory view illustrating the operation of the tourbillon with the constant-force device in the second embodiment according to the present invention.

FIG. 22 is a diagram illustrating the operation of the tourbillon 230 with a constant-force device.

The operation of the escapement mechanism 102 and the balance with hairspring 101 mounted in the inner carriage 234 is the same as that in the first embodiment described above, so a description thereof will be left out.

First, the operation of the inner carriage 234 and of the constant-force device 203 provided in the outer carriage 233 will be described.

Since the external gear portion 41 is in mesh with the fifth wheel & pinion 28, the rotational force of the movement barrel 22 is transmitted to the outer carriage 33 via the front train wheel. Regarding the stop wheel drive wheel 178, the drive wheel pinion portion 185*a* is in mesh with the toothed portion 31*d* of the stationary wheel 31. Thus, when the outer carriage 233 rotates, the stop wheel drive wheel 178 revolves around the stationary wheel 31 (clockwise in FIG. 22, see an arrow Y9) while rotating around the axis of the drive wheel pinion portion 185*a* (clockwise in FIG. 22, see an arrow Y8).

The drive gear 184 of the stop wheel drive wheel 178 is in mesh with a stop wheel pinion portion 187*a* of the stop wheel 179. Thus, the stop gear 186 integrated with the stop wheel pinion portion 187*a* revolves around the stationary wheel 31 (clockwise in FIG. 22, see an arrow Y11) while rotating around the axis of the stop wheel pinion portion 187*a* (counterclockwise in FIG. 22, see an arrow Y10).

Here, in the state in which the pawl portion 172 of the stopper lever 171 is engaged with the hook portion 188 of the stop gear 186, the rotation of the stop wheel 179 is regulated. As a result, the stop wheel 179, the stop wheel drive wheel 178, and the outer carriage 233 are at rest.

The engagement amount (mesh amount) of the hook portion 188 of the stop wheel 186 and the stopper lever 171 at point 0s is the same as that in the first embodiment described above. That is, the range of the hook portion 188 corresponding to the rotation by six degrees around the rotation axis of the outer carriage 233 and of the inner carriage 234 is engaged with the pawl portion 172.

On the other hand, regarding the stopper lever 171 rotatably supported by the first outer carriage bearing portion 235 of the outer carriage 233, the first arm 173*a* fixed to this stopper lever 171 is pressed by the constant-force spring 268. Thus, the stopper lever 171 rotates around the axis of the proximal end portion 171*a* such that the pawl portion 172 moves away from the stop wheel 179 (clockwise in FIG. 22, see an arrow Y12).

At this time, the inner carriage drive wheel 177 moving integrally with the stopper lever 171 is in mesh with the drive wheel pinion portion 185*a*; and, further, the pawl portion 172 and the hook portion 188 of the stop wheel 179 are engaged with each other, whereby the drive wheel pinion portion 185*a* is at rest, so that the inner carriage drive wheel 177 rotates (counterclockwise in FIG. 22, see an arrow Y13).

Further, since the inner carriage pinion portion 191 is in mesh with the inner carriage drive wheel 177, the inner carriage pinion portion 191 rotates (clockwise in FIG. 22, see an arrow Y14). Additionally, the inner carriage 234 integrated with the inner carriage pinion portion 191 rotates, and the escapement mechanism 102 and the balance with hairspring 101 (see FIG. 21) are driven.

Subsequently, when one second elapses from point 0s, the engagement of the hook portion 188 of the stop gear 186 and the pawl portion 172 of the stopper lever 171 is released. Then, the outer carriage 233 rotates. By this arrangement, the drive wheel 178 revolves around the stationary wheel 31 while rotating around the axis of the drive wheel pinion portion 185*a*; at the same time, the stop wheel 179 revolves around the stationary wheel 31 while rotating around the axis of the stop wheel pinion portion 187*a*. In other words, the stop wheel 179 moves while rotating toward the pawl portion 172 of the stopper lever 171.

Furthermore, the stop wheel 179 is engaged with the hook portion 188 (188B) next to the hook portion 188 (188A) which has been engaged with the pawl portion 172 at point 0s, and stops again. When the engagement of the hook portion 188 and the pawl portion 172 is released, the stop wheel 179 rotates; the angle by which the outer carriage 233 rotates until the stop wheel 179 stops again is six degrees.

Thus, the second embodiment described above provides the same effect as the first embodiment described above.

The present invention is not restricted to the above embodiments; it also covers various modifications of the above embodiments made without departing from the scope of the gist of the present invention.

What is claimed is:

1. An operation stabilization mechanism comprising:

a first carriage to which a rotational drive force of a train wheel is transmitted and which is rotatably supported with respect to a main plate;

a second carriage rotatably supported with respect to the first carriage;

a constant-force spring provided between the first carriage and the second carriage and configured to impart a rotational force to the second carriage so that the second carriage undergoes rotation with respect to the first carriage;

an escapement/governor mechanism mounted in the second carriage and configured to be driven by a rotational torque generated through rotation of the second carriage and transmitted to the escapement/governor mechanism; and a stopper lever mounted to undergo rotational movement relative to the first carriage for suppressing fluctuations in the rotational torque transmitted to the escapement/governor mechanism.

2. The operation stabilization mechanism according to claim 1, wherein the escapement/governor mechanism is equipped with an escape wheel & pinion configured to undergo rotation on the second carriage, and a balance with hairspring configured to undergo oscillation movement on the second carriage as the escape wheel & pinion rotates.

3. The operation stabilization mechanism according to claim 2, wherein the first carriage comprises a stop wheel having a stop wheel bearing configured to rotate around a rotation axis of the first carriage through the rotation of the first carriage, a stop wheel shaft body rotatably supported by the stop wheel bearing, and a stop gear configured to rotate integrally with the stop wheel shaft body; and wherein the second carriage comprises a stopper configured to be engaged with the stop gear of the first carriage.

4. The operation stabilization mechanism according to claim 1, wherein the first carriage comprises a stop wheel having a stop wheel bearing configured to rotate around a rotation axis of the first carriage through the rotation of the first carriage, a stop wheel shaft body rotatably supported by the stop wheel bearing, and a stop gear configured to rotate integrally with the stop wheel shaft body; and wherein the second carriage comprises a stopper configured to be engaged with the stop gear of the first carriage.

5. A movement equipped with an operation stabilization mechanism as claimed in claim 1.

6. A mechanical timepiece equipped with a movement as claimed in claim 5.

7. The operation stabilization mechanism according to claim 1, wherein the first carriage is configured to store a resilient force in the constant-force spring by rotational movement of the first carriage relative to the main plate.

8. The operation stabilization mechanism according to claim 1, wherein the stopper lever has a proximal end portion and a distal end portion, the stopper lever being rotatably supported at the proximal end portion by a bearing portion of the first carriage.

9. The operation stabilization mechanism according to claim 8, wherein the second carriage has a rotary member; and wherein the proximal end portion of the stopper lever has an insertion hole configured to receive a shaft portion of the rotary member of the second carriage.

10. The operation stabilization mechanism according to claim 8, wherein the stopper lever is formed so as to be gradually tapered toward the distal end portion thereof.

11. The operation stabilization mechanism according to claim 10, wherein a slit is formed at the distal end portion of the stopper lever; and further comprising a pawl portion mounted to the slit so as to protrude from the distal end portion of the stopper lever.

12. The operation stabilization mechanism according to claim 11, further comprising a first arm and a second arm integral with the stopper lever and extending along a protruding direction of the pawl portion, the first and second arms being gradually tapered distal ends thereof.

13. The operation stabilization mechanism according to claim 12, wherein the first arm has a bearing seat provided with a protrusion; and wherein a distal end of the constant-force spring is configured to come into contact with the protrusion of the bearing seat.

14. The operation stabilization mechanism according to claim 11, further comprising a support bar provided around the bearing portion of the first carriage, the support bar having a stop wheel with a stop gear having a plurality of radially extending hook portions; and wherein the pawl portion of the stopper lever is configured to be engaged with and released from the hook portions of the stop gear.

15. The operation stabilization mechanism according to claim 14, further comprising a first arm and a second arm integral with the stopper lever and extending along a protruding direction of the pawl portion; wherein in a state in which the pawl portion of the stopper lever is engaged with one of the hook portions of the stop gear, rotation of the stop wheel is regulated such that the first carriage are at rest, and the first arm of the stopper lever is pressed by the constant-force spring and the stopper lever undergoes rotation so that the pawl portion moves away from the stop wheel.

16. An operation stabilization mechanism comprising:

a constant-force spring;

a first carriage to which a rotational drive force of a train wheel is transmitted so that the first carriage undergoes rotation to store a resilient force in the constant-force spring;

a second carriage configured to be imparted with a rotational force by the constant-force spring so that the second carriage undergoes rotation with respect to the first carriage;

an escapement/governor mechanism mounted in the second carriage and configured to be driven by a rotational torque generated through rotation of the second carriage and transmitted to the escapement/governor mechanism; and a stopper lever mounted to undergo rotational movement relative to the first carriage for suppressing fluctuations in the rotational torque transmitted to the escapement/governor mechanism.

17. The operation stabilization mechanism according to claim 16, wherein the stopper lever has a proximal end portion and a distal end portion, the stopper lever being rotatably supported at the proximal end portion by a bearing portion of the first carriage.

18. The operation stabilization mechanism according to claim 17, wherein the second carriage has a rotary member; and wherein the proximal end portion of the stopper lever has an insertion hole configured to receive a shaft portion of the rotary member of the second carriage.

19. A movement equipped with an operation stabilization mechanism as claimed in claim 16.

20. A mechanical timepiece equipped with a movement as claimed in claim 19.

* * * * *